US012252834B2

(12) United States Patent
Jung et al.

(10) Patent No.: US 12,252,834 B2
(45) Date of Patent: Mar. 18, 2025

(54) DETERGENT STORAGE CONTAINER AND METHOD FOR MANUFACTURING THE SAME

(71) Applicant: LG Electronics Inc., Seoul (KR)

(72) Inventors: Sungwoon Jung, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/006,527

(22) Filed: Aug. 28, 2020

(65) Prior Publication Data

US 2021/0062395 A1 Mar. 4, 2021

(30) Foreign Application Priority Data

| | | |
|---|---|---|
| Aug. 29, 2019 | (KR) | 10-2019-0106714 |
| Aug. 29, 2019 | (KR) | 10-2019-0106716 |
| Feb. 7, 2020 | (KR) | 10-2020-0015212 |
| Aug. 7, 2020 | (KR) | 10-2020-0099425 |

(51) Int. Cl.
*D06F 39/02* (2006.01)
*D06F 103/60* (2020.01)

(52) U.S. Cl.
CPC ..... *D06F 39/022* (2013.01); *D06F 2103/60* (2020.02)

(58) Field of Classification Search
CPC ..... D06F 39/02; D06F 39/022
See application file for complete search history.

(56) References Cited

U.S. PATENT DOCUMENTS

| | | | | |
|---|---|---|---|---|
| 2009/0095750 | A1* | 4/2009 | Vitan | A47L 15/4253 206/459.1 |
| 2009/0107188 | A1 | 4/2009 | Park | |
| 2010/0000578 | A1* | 1/2010 | Hendrickson | D06F 39/022 68/12.18 |
| 2010/0071777 | A1* | 3/2010 | Smith | D06F 39/022 222/325 |
| 2014/0144191 | A1* | 5/2014 | Back | G01R 27/00 222/173 |
| 2017/0191205 | A1* | 7/2017 | Jung | D06F 39/022 |
| 2017/0233931 | A1 | 8/2017 | Lee | |
| 2019/0153655 | A1 | 5/2019 | Jung et al. | |

FOREIGN PATENT DOCUMENTS

| | | |
|---|---|---|
| CN | 101142355 | 3/2008 |
| CN | 103835098 | 6/2014 |
| CN | 205024472 | 2/2016 |
| CN | 205313862 U | 6/2016 |

(Continued)

OTHER PUBLICATIONS

KR20110099917A Machine Translation (Year: 2011).*

(Continued)

*Primary Examiner* — Spencer E. Bell
(74) *Attorney, Agent, or Firm* — Fish & Richardson P.C.

(57) ABSTRACT

A detergent storage container for a laundry treating apparatus includes a detergent storage member that defines a storage space configured to store laundry detergent, and a residual amount detecting unit disposed at the detergent storage member and configured to detect a residual amount of laundry detergent stored in the detergent storage member.

24 Claims, 23 Drawing Sheets

(56) References Cited

FOREIGN PATENT DOCUMENTS

| | | | | |
|---|---|---|---|---|
| CN | 106400403 | | | 2/2017 |
| CN | 107059347 | | | 8/2017 |
| EP | 2733249 | | | 11/2016 |
| EP | 3190222 | | | 12/2017 |
| JP | 62037721 | | | 3/1987 |
| JP | 07016122 | | | 3/1995 |
| JP | 2000-254392 | | | 9/2000 |
| JP | 2019-500173 | | | 1/2019 |
| KR | 1020060101952 | | | 9/2006 |
| KR | 20110099917 | A | * | 9/2011 |
| KR | 1020190044228 | | | 4/2019 |

OTHER PUBLICATIONS

EP Extended European Search Report in European Appln. No. 20193316.5, dated Nov. 12, 2020, 8 pages.
PCT International Search Report and Written Opinion in International Appln. No. PCT/KR2020/011566, dated Dec. 9, 2020, 14 pages.
Office Action in Japanese Appln. No. 2020-145489, dated Sep. 7, 2021, 9 pages (with English translation).
Office Action in Chinese Appln. No. 202010886769.3, dated Jul. 13, 2022, 26 pages (with English translation).
Notice of Allowance in Japanese Appln. No. 2020-145489, dated Jan. 10, 2023, 5 pages (with English translation).

* cited by examiner (a)

(b)

(c)

(a)

(b)

DETERGENT STORAGE CONTAINER AND METHOD FOR MANUFACTURING THE SAME

CROSS-REFERENCE TO RELATED APPLICATIONS

Pursuant to 35 U.S.C. § 119(a), this application claims the benefit of the earlier filing dates and the right of priority to Korean Patent Applications No. 10-2019-0106714, filed on Aug. 29, 2019, No. 10-2019-0106716, filed on Aug. 29, 2019, No. 10-2020-0015212, filed on Feb. 7, 2020 and No. 10-2020-0099425, filed on Aug. 7, 2020, the contents of which are incorporated by reference herein in their entirety.

TECHNICAL FIELD

The present disclosure relates to a detergent supply device that automatically supplies detergent, a detergent storage container installed in the detergent supply device, and a method for manufacturing the same.

BACKGROUND

A laundry treating apparatus may receive clothing, bedding or the like (hereinafter, referred to as laundry) into a drum and remove contamination from the laundry. A user may put laundry to be treated in the laundry treating apparatus and supply detergent or softener to treat the laundry.

The laundry treating apparatus may include a tub accommodated inside a main body forming an outer appearance, a drum rotatably mounted inside the tub to put laundry thereinto, and a detergent supply device for supplying detergent into the drum.

In some cases, the detergent supply device may perform a function of supplying laundry detergent to supply detergent (hereinafter, referred to as a "laundry detergent") so as to enhance washing effect of laundry put in the drum.

The laundry detergent may include a substance that enhances the washing effect, such as textile detergent, fabric softener, and fabric bleach. For example, the laundry detergent may include powder type laundry detergent or liquid type laundry detergent.

In some cases, the detergent component may not be dissolved after washing and remain in a water tank or the laundry due to its insufficient solubility, and thus a user may use liquid laundry detergent having better solubility instead than powder type laundry detergent.

In some cases, a user may manually open a door of the laundry treating apparatus to supply laundry detergent, and then manually put laundry detergent in the detergent storage container installed inside the door. In some cases, the user may frequently open and close a drawer to supply laundry detergent or softener, which may lead to inconvenience.

In some cases, a detergent supply device may supply an amount of laundry detergent to a tub according to the laundry treating process when a user operates a laundry treating apparatus in a state where laundry detergent or softener is put in a storage container separately provided in the laundry treating apparatus. In some cases, the user may not need to supply laundry detergent or softener every time the laundry treating process is performed, which may improve the user's convenience.

In some cases, where a detergent dispensing device automatically supplies laundry detergent, a user may periodically replenish the detergent in the detergent storage container. For instance, in order to visually check how much laundry detergent is stored in the detergent storage container, the user may frequently open the detergent storage container in which detergent or softener is stored.

In some cases, in order to automatically detect the laundry detergent stored in the storage container, a sensor may be separately installed. In some cases, a residual amount of laundry detergent may be incorrectly sensed by the laundry detergent stuck to the storage container.

SUMMARY

The present disclosure describes a detergent storage container and a detergent supply device including the same capable of storing a large amount of laundry detergent and automatically supplying laundry detergent stored therein to a drum so as to enhance a user's convenience.

The present disclosure also describes a detergent storage container and a detergent supply device including the same capable of automatically detecting a residual amount of laundry detergent stored in the detergent storage container to notify a user of this information, thereby enhancing user's convenience.

The present disclosure further describes a detergent storage container and a detergent supply device including the same capable of smoothly detecting a residual amount of laundry detergent stored in the detergent storage container in a state where the detergent storage container is coupled to a housing.

The present disclosure further describes a detergent storage container and a detergent supply device including the same capable of helping to prevent a false sense of residual amount of laundry detergent stored in the storage container.

The present disclosure further describes a structure of a detergent storage container and a method for manufacturing the same capable of storing a large amount of laundry detergent, automatically supplying laundry detergent stored therein to a drum, and automatically detecting a residual amount of laundry detergent stored in the detergent storage container so as to enhance user's convenience.

The present disclosure further describes a detergent storage container and a method for manufacturing the same capable of enhancing productivity by simplifying a manufacturing process such that a structure to install a residual amount detecting unit at one side of the detergent storage container is reflected to allow them to be easily coupled to each other.

The present disclosure further describes a detergent storage container and a method for manufacturing the same to which a structure capable of preventing a false sense of residual amount of laundry detergent is applied.

According to one aspect of the subject matter described in this application, a detergent storage container for a laundry treating apparatus includes a detergent storage member that defines a storage space configured to store laundry detergent, and a residual amount detecting unit disposed at the detergent storage member and configured to detect a residual amount of laundry detergent stored in the detergent storage member.

Implementations according to this aspect may include one or more of the following features. For example, the detergent storage member may include a coupling portion having a shape corresponding to an outer shape of the residual amount detecting unit. In some examples, the detergent storage member may define a mounting groove that is recessed along a circumference of the coupling portion, and the residual amount detecting unit may be fitted to the mounting groove.

In some implementations, the residual amount detecting unit may include a support bracket coupled to the detergent storage member, an electrode disposed at the support bracket, where at least a portion of the electrode is exposed to an inner space of the detergent storage member, and a connection terminal portion disposed at an outer portion of the support bracket. In some examples, the residual amount detecting unit may further include a detergent blocking rib that protrudes from an inner surface of the support bracket and that covers a portion of the electrode exposed to the inner space of the detergent storage member.

In some implementations, the detergent blocking rib may include a blocking portion that is inclined with respect to a vertical direction passing a bottom surface of the detergent storage member, the blocking portion being configured to restrict movement of the laundry detergent toward the electrode.

In some examples, the electrode may include a plurality of electrodes having different lengths from one another, and the plurality of electrodes may include a first electrode disposed at a first height from a lower surface of the detergent storage member, and a second electrode disposed at a second height from the lower surface of the detergent storage member, where the second height is different from the first height. In some implementations, the residual amount detecting unit may include an electrode sensor terminal that is disposed inside the connection terminal portion and that supports the electrode, the electrode sensor terminal being configured to transmit electrical signals.

In some implementations, the detergent storage member may include a pump receiving portion configured to discharge the laundry detergent in the detergent storage container, and the residual amount detecting unit may be disposed above the pump receiving portion. In some examples, the residual amount detecting unit may be disposed at a rear portion of the detergent storage member, and the pump receiving portion may protrude outward relative to the rear portion of the detergent storage member.

In some examples, the residual amount detecting unit may include a support bracket coupled to a rear surface of the detergent storage member, an electrode disposed at the support bracket, at least a portion of the electrode being exposed to an inner space of the detergent storage member, and a connection terminal portion disposed at an outer portion of the support bracket. In some examples, the connection terminal portion may be disposed above the pump receiving portion.

In some implementations, at least a portion of the residual amount detecting unit may be exposed to an inner space of the detergent storage member. For example, the residual amount detecting unit may include an electrode, where at least a portion of the electrode is exposed to the inner space of the detergent storage member.

In some implementations, the residual amount detecting unit may include a support bracket coupled to a rear surface of the detergent storage member, and a connection terminal portion disposed at an outer portion of the support bracket, where the electrode may be disposed inside the support bracket, and at least a part of the electrode may be exposed at one side of the support bracket.

According to another aspect, a detergent supply device for a laundry treating apparatus includes a housing disposed inside the laundry treating apparatus, a storage container frame configured to be withdrawn from the housing, a detergent storage container configured to be mounted to the storage container frame and to store laundry detergent, a laundry detergent pump disposed at a rear portion of the housing and configured to supply the laundry detergent to the laundry treating apparatus, and a connection terminal receiving member that is disposed inside the housing and protrudes toward the detergent storage container. The detergent storage container includes a detergent storage member that defines a storage space configured to store the laundry detergent, and a residual amount detecting unit disposed at the detergent storage member and configured to detect a residual amount of laundry detergent stored in the detergent storage member.

Implementations according to this aspect may include one or more of the following features or the features described above. For example, the residual amount detecting unit may include a support bracket coupled to the detergent storage member, an electrode disposed at the support bracket, and a connection terminal portion coupled to an outer portion of the support bracket.

In some implementations, the detergent supply device may further include a detergent suction pipe that is disposed below the connection terminal receiving member and protrudes from the rear portion of the housing toward an inner space of the detergent storage member. In some implementations, the detergent supply may further include a detergent suction pipe that is connected to the laundry detergent pump and configured to receive the laundry detergent stored in the detergent storage container.

In some examples, the detergent storage member may include a pump receiving portion that protrudes from a rear portion of the detergent storage member and that is configured to receive the laundry detergent pump, and the residual amount detecting unit may be disposed above the pump receiving portion. In some examples, the connection terminal portion may be inserted into and electrically connected to the connection terminal receiving member.

In some implementations, the electrode may include a plurality of electrodes, and the connection terminal receiving member may include a connection terminal housing that defines an appearance of the connection terminal receiving member, and a plurality of connection terminals that are configured to be connected to the plurality of electrodes based on the connection terminal portion being inserted into the connection terminal housing.

In some implementations, the detergent supply device may include a sealing member disposed in the connection terminal receiving member and configured to fit into the connection terminal housing, where the sealing member may include a plurality of regions that separate the plurality of connection terminals from one another.

In some implementations, the connection terminal housing may define a detergent outlet hole at a lower surface of the connection terminal housing, and may be configured to discharge the laundry detergent in the connection terminal housing through the detergent outlet hole.

In some implementations, the detergent storage member may include a pump receiving portion that protrudes toward the laundry detergent pump from a rear portion of the detergent storage container, and the laundry detergent pump may be configured to receive the laundry detergent in the detergent storage container through the pump receiving portion. In some examples, the connection terminal portion may be disposed above the pump receiving portion.

According to another aspect, a method for manufacturing a detergent storage container includes manufacturing a detergent storage member, where the detergent storage member defines an upper opening, a storage space configured to store laundry detergent, and a coupling portion that penetrates one side of the detergent storage member. The method further includes manufacturing a residual amount detecting unit having a plate shape, where the residual amount detecting unit includes a support bracket and a plurality of electrodes coupled to the support bracket by an insert-molding process. The method further includes adhering the residual amount detecting unit to the coupling portion, and coupling a storage container cover to the upper opening of the detergent storage member.

Implementations according to this aspect may include one or more of the following features. For example, manufacturing the detergent storage member may include forming a mounting groove at the coupling portion, and the method may include inserting the residual amount detecting unit into the mounting groove to mount the residual amount detecting unit to a circumference of the coupling portion.

In some implementations, manufacturing the residual amount detecting unit may include forming a mounting protrusion disposed at the support bracket of the residual amount detecting unit, where the mounting protrusion has a shape corresponding to the mounting groove. In some examples, manufacturing the residual amount detecting unit may include forming a detergent blocking rib as an integral part of the support bracket, where the detergent blocking rib protrudes from an inner surface of the support bracket and covering portions of the plurality of electrodes exposed from the support bracket.

In some examples, adhering the residual amount detecting unit to the coupling portion may include placing the mounting protrusion in the mounting groove and then adhering the mounting protrusion and the coupling portion to each other by bonding or heat welding.

In some implementations, the detergent supply device may store a large amount of laundry detergent with a storage container capable of storing different laundry detergents. In some examples, it may be possible to automatically supply an appropriate amount of laundry detergent toward the tub by an operation of the laundry detergent pump in a washing process, and when needed, the user may directly put a desired amount of laundry detergent into the manual detergent dispensing unit, thereby further enhancing the user's convenience.

In some implementations, an electrode may be installed on a rear surface portion of a detergent storage container to contact laundry detergent stored in the storage container. The electrode may be configured to, based on the laundry detergent not contacting the electrode, automatically detect that the residual amount of the laundry detergent stored in the storage container is below a reference amount. Thus, the user's convenience may be further expanded by informing the user of this information.

In some implementations, where the detergent storage container is mounted in the housing, a connection terminal portion of a residual amount detecting unit is coupled to a connection terminal receiving member, so that the residual amount of laundry detergent stored in the detergent storage container may be detected.

In some implementations, a detergent blocking rib may be disposed at an inner surface of the support bracket to surround one side of the exposed electrode, thereby preventing a false sense of the residual amount of the laundry detergent stored in the detergent storage container.

In some implementations, where a large amount of laundry detergent is stored in a storage space of the detergent storage container, a proper amount of laundry detergent may be automatically supplied toward a tub by an operation of a laundry detergent pump in a washing process, and the residual amount of the detergent is automatically detected by the residual amount detecting unit, thereby further enhancing user's convenience.

In some examples, a mounting groove may be defined along a circumference of a coupling portion into which the residual amount detecting unit is installed at one side of the rear surface of the detergent storage container, so that a mounting protrusion formed on an outer portion of the residual amount detecting unit may be brought into contact and fixed therein. Accordingly, the residual amount detecting unit may be easily coupled to the detergent storage container, and productivity may be improved due to the simplified manufacturing process.

In some examples, a detergent blocking rib may be disposed at an inner surface of the support bracket to surround one side of the exposed electrode, which may prevent or reduce a false sense of the residual amount of the laundry detergent stored in the detergent storage container.

DETAILED DESCRIPTION

Hereinafter, a laundry treating apparatus will be described in more detail with reference to the accompanying drawings.

In the present specification, the same or similar elements are designated with the same numeral references even in different implementations and their redundant description will be omitted.

In some examples, a structure applied to any one implementations may be also applied in the same manner to another implementation.

In describing the present disclosure, if a detailed explanation for a related known function or construction is considered to unnecessarily divert the gist of the present disclosure, such explanation has been omitted but would be understood by those skilled in the art.

The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

Figure 1:
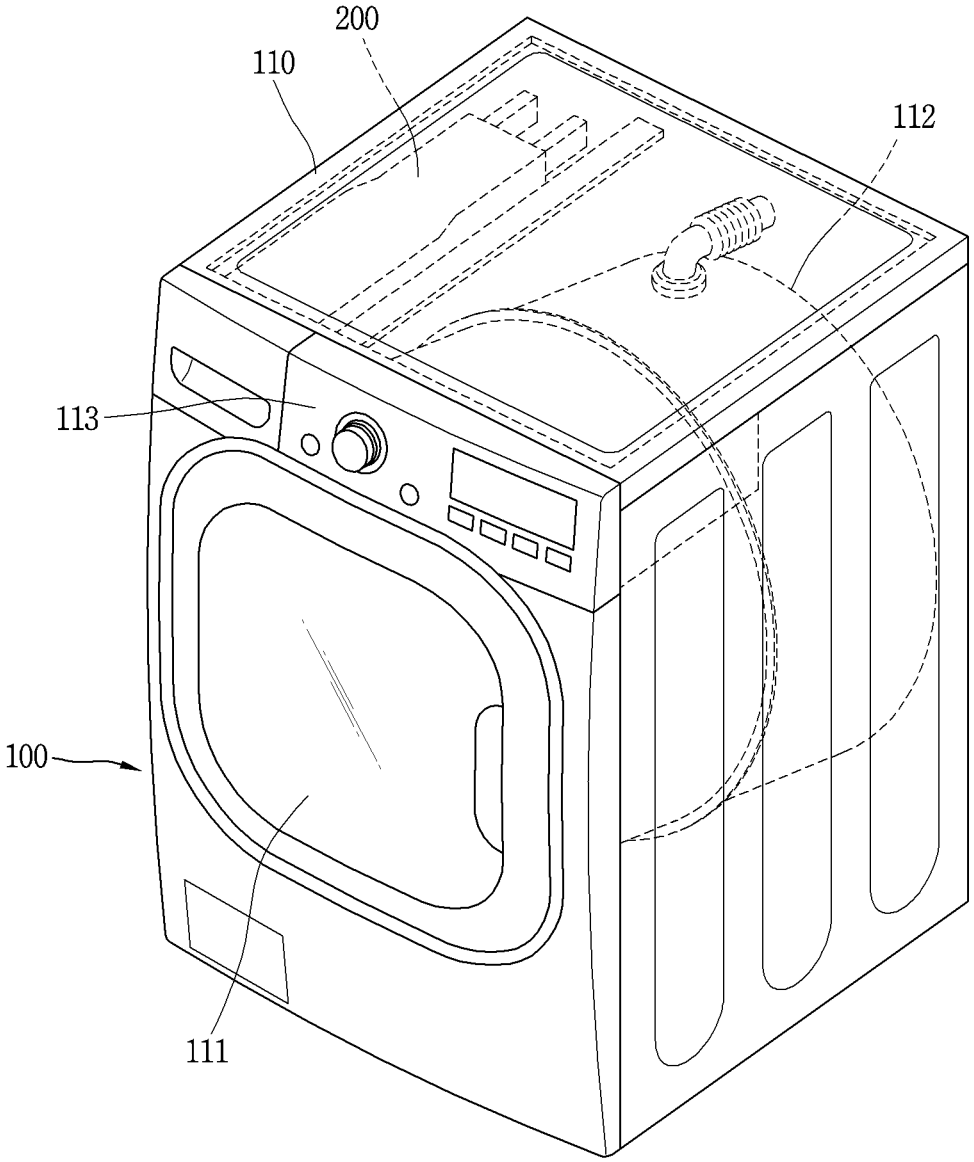
FIG. 1 is a perspective view illustrating an example of a laundry treating apparatus.

FIG. 1 is a perspective view illustrating an example of a laundry treating apparatus 100 in which a detergent supply device 200 is installed.

The laundry treating apparatus 100 may include a washing machine for inserting laundry into a washing tub and then performing a laundry treating operation such as washing, rinsing, and dehydration, through laundry detergent being added thereto, a dryer for inserting wet fabric to perform drying, and the like.

Here, "laundry detergent" may include detergent, softener, and bleach in the form of powder, solid or liquid as a material used to sterilize, disinfect laundry or fabric, or remove impurities.

Specifically, the laundry detergent may denote fabric softener for softening laundry, fabric or the like, and the laundry detergent may denote bleach that degrades or removes colored substances contained in laundry or fabric through chemical action to whiten the fabric or the like.

In some examples, the laundry treating apparatus may be divided into a top-loading type and a front-loading type. FIG. 1 shows an example of a front-loading type laundry treating apparatus 100.

As shown in FIG. 1, the laundry treating apparatus 100 has a structure including a main body 110 defining an outer appearance, an operation unit 113 that receives various control commands from a user and has a display module for displaying information on an operation state, and a door 111 rotatably provided at a front portion of the main body 110 to allow the entry and exit of laundry.

The main body 110 may define an outer appearance of the laundry treating apparatus 100, and may be provided with a space capable of receiving various components constituting the laundry treating apparatus 100 inside the main body 110. A drum 112 for receiving laundry loaded through the door 111 may be provided inside the main body 110.

The drum 112 may include an outer tub filled with wash water, and an inner tub provided to be rotatable inside the outer tub to receive laundry. One side of the drum 112 may be provided with a balancer to compensate for eccentricity caused by rotation.

The operation unit 113 may be provided on a front portion of the main body 110, and may include various operation keys for operating the operation state of the laundry treating apparatus 100 and a display for displaying the operation state of the laundry treating apparatus 100.

The door 111 serves to open and close an entrance hole of laundry, and may be made of a transparent member such as tempered glass to look inside the main body 110.

In some implementations, the laundry treating apparatus 100 may include a detergent supply device 200.

The detergent supply device 200 may be provided at an upper side of the main body 110.

The detergent supply device 200 stores laundry detergent, and serves to automatically supply laundry detergent into the drum 112 during a washing process. Here, the laundry detergent denotes a material capable of enhancing the washing effect of laundry, as described above, and may denote liquid fabric detergent and liquid fabric softener.

Figure 2:
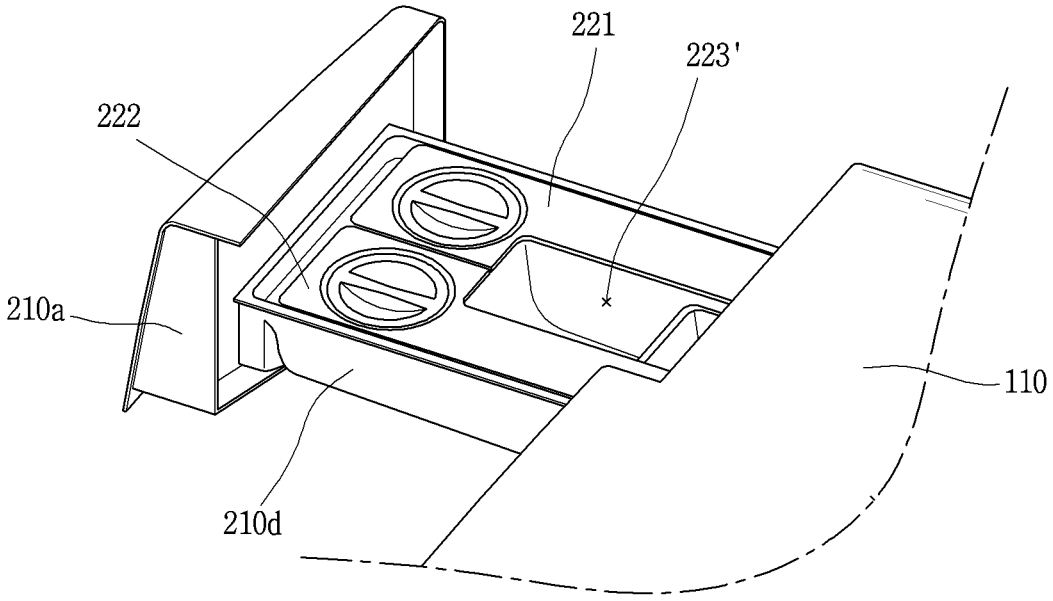
FIG. 2 is a conceptual view illustrating an example of a detergent supply device withdrawn from a main body of the laundry treating apparatus.

FIG. 2 is a conceptual view illustrating an example state in which the detergent supply device 200 is withdrawn from the main body 110.

The detergent supply device 200 may include detergent storage containers 221, 222 mounted on a storage container frame 210*d* defining an outer appearance.

When a user grips a front portion 210*a* of the storage container frame 210*d* and then pulls it out, the detergent supply device 200 may be slidably withdrawn from a front portion of the main body 110 of the laundry treating apparatus to expose at least part thereof to the outside.

In some examples, when the user pushes the front portion 210*a* toward the main body 110, the detergent supply device 200 may be mounted on the housing 210 provided in the main body 110 while being slid in a direction toward the main body.

As illustrated in FIG. 2, when the detergent supply device 200 is withdrawn from the main body 110, a plug 224 of the detergent storage container 221, 222, a manual detergent dispensing unit 223' and a softener housing receiving portion 223 may be exposed to the outside, and the user may withdraw the detergent supply device 200 from the main body, and then replenishes laundry detergent in the storage container 221, 222, or add laundry detergent to the manual detergent dispensing unit 223' and the softener housing receiving portion 223.

Figure 3:
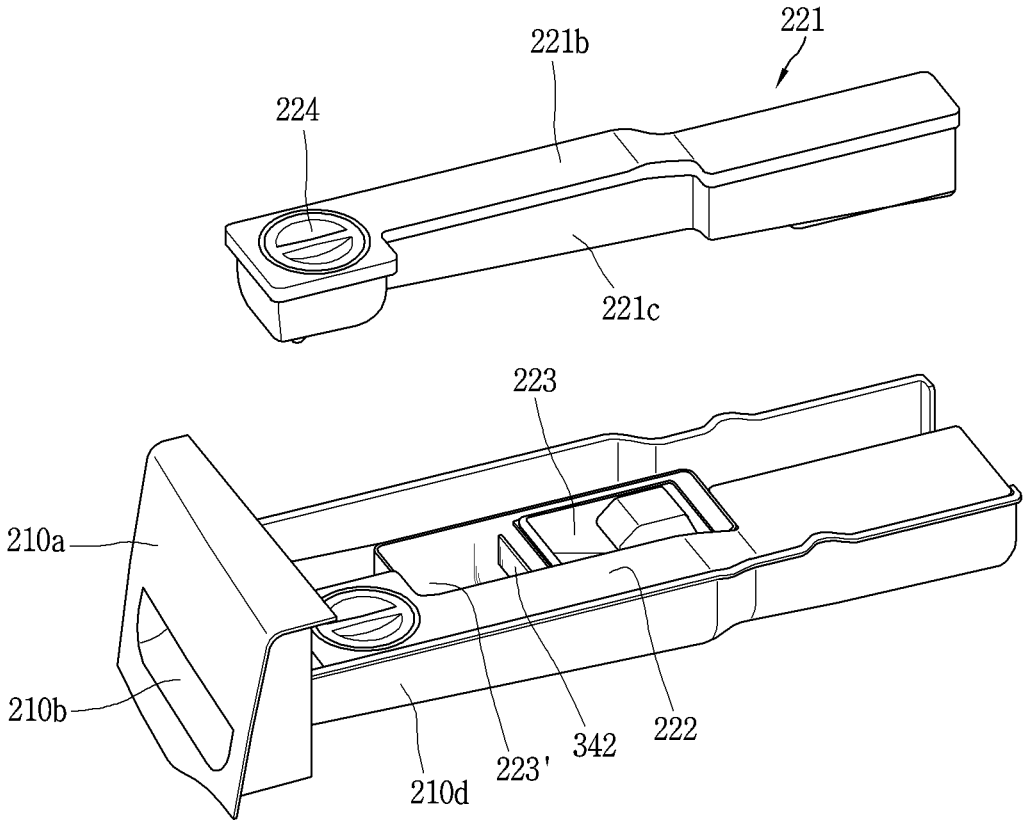
FIG. 3 is a perspective view illustrating the detergent supply device that is completely withdrawn out to an outside.

FIG. 3 is a perspective view illustrating an example state in which the detergent supply device 200 is completely withdrawn out to the outside.

The detergent supply device 200 may be withdrawn from or inserted into the main body 110 by the user. When the user grips a front portion 210*a* of the storage container frame 210*d* and then pulls it out, the detergent supply device 200 may be withdrawn out in a sliding manner from a front portion of the main body 110.

A plurality of detergent storage containers 221, 222 may be provided inside the storage container frame 210*d*.

Inside the storage container frame 210*d*, a first detergent storage container 221 and a second detergent storage container 222 in which first and second laundry detergents are stored therein, respectively, may be mounted to store different laundry detergents therein.

Here, the first laundry detergent may denote liquid detergent, and the second laundry detergent may denote liquid fabric softener. In addition or alternatively, the first laundry detergent may denote fabric softener, and the second laundry detergent may denote detergent.

The volumes of laundry detergents that may be accommodated in the first detergent storage container 221 and the second detergent storage container 222 may be similar to each other. However, considering that detergent is used more than softener in a general laundry treating process, the capacity of laundry detergent that may be accommodated in either one storage container may be configured to be larger, and liquid detergent may be accommodated in the storage container.

In other words, the first detergent storage container 221 and the second detergent storage container 222 may accommodate either one of detergent and softener therein, and there are some differences in their shapes, but it may be seen that the structure and function thereof correspond to each other.

When the first and second detergent storage containers 221, 222 are inserted into the laundry treating apparatus 100 while being mounted in the storage container frame 210*d*, the first detergent storage container 221 and the second detergent storage container 222 may be in communication with laundry detergent pumps 231, 232 (see, FIG. 4) provided on the rear surface to supply detergent or softener stored therein to a tub of the laundry treating apparatus by the laundry detergent pumps 231, 232.

The detergent storage member 221*c*, 222*c* extending in a front-rear direction of the main body 110 may be provided with a space capable of storing a predetermined amount of laundry detergent therein. In some examples, detergent storage member 221*c*, 222*c* may have a rod shape extending inward of the main body 110.

In some examples, as illustrated in FIG. 3, the first detergent storage container 221 and the second detergent storage container 222 may be defined in a "⊏"-shape, and the first detergent storage container 221 and the second detergent storage container 222 may be mounted inside the storage container frame 210*d* to face each other.

Here, a lower surface of the first detergent storage container 221 and the second detergent storage container 222 may be disposed to have a predetermined inclination, thereby facilitating the flow of laundry detergent accommodated in each of the detergent storage containers 221, 222.

That is, the first detergent storage container 221 and the second detergent storage container 222 are formed to be inclined to have a predetermined inclination toward the rear side, so that each laundry detergent stored in the first detergent storage container 221 and the second detergent storage container 222 may be smoothly supplied toward the tub through the laundry detergent pumps 231, 232.

The detergent storage containers 221, 222 may include detergent storage members 221*c*, 222*c* configured to accommodate laundry detergent, and storage container covers 221*b*, 222*b* to cover each of the detergent storage members 221*c*, 222*c*.

Furthermore, the first detergent storage container 221 and the second detergent storage container 222 may be mounted at one side of the storage container frame 210*d* to face each other, and thus the manual detergent dispensing unit 223' may be disposed between the first detergent storage container 221 and the second detergent storage container 222, thereby allowing the user to manually put detergent therein. The manual detergent dispensing unit 223' may be configured with a predetermined space formed between the first detergent storage container 221 and the second detergent storage container 222.

In some implementations, the softener housing receiving portion 223 with a predetermined space in parallel to the manual detergent dispensing unit 223' in a front-rear direction to manually add fabric softener thereto may be disposed.

The softener housing receiving portion 223 may be configured to have a predetermined space to manually supply softener, and a softener housing may be provided. The softener housing may be mounted to fit into the softener housing receiving portion 223 so as to be spaced apart by a predetermined distance. Accordingly, when softener is supplied toward the softener housing and the softener overflows, it may move between the softener housing and the softener housing receiving portion 223 to move toward a detergent input hole 214, which will be described later.

Plugs 224 may be provided on each of the storage container covers 221*b*, 222*b* to cover the first detergent storage container 221 and the second detergent storage container 222, respectively. The plug 224 may be detachable from the detergent storage container 221, 222 when rotated in one direction. Accordingly, when the plug 224 is removed from the detergent storage container 221, 222, a user will be able to supply laundry detergent to the detergent storage container 221, 222.

For example, when a user recognizes a notification of insufficient laundry detergent outputted to the operation unit 113 of the laundry treating apparatus 100, the user will withdraw the storage container frame 210*d* from the housing 210, rotate the plug 224 in one direction to remove the plug 224 that is coupled to the detergent storage containers 221, 222 exposed to the outside, then refill laundry detergent or softener in the detergent storage containers 221, 222.

Figure 4:
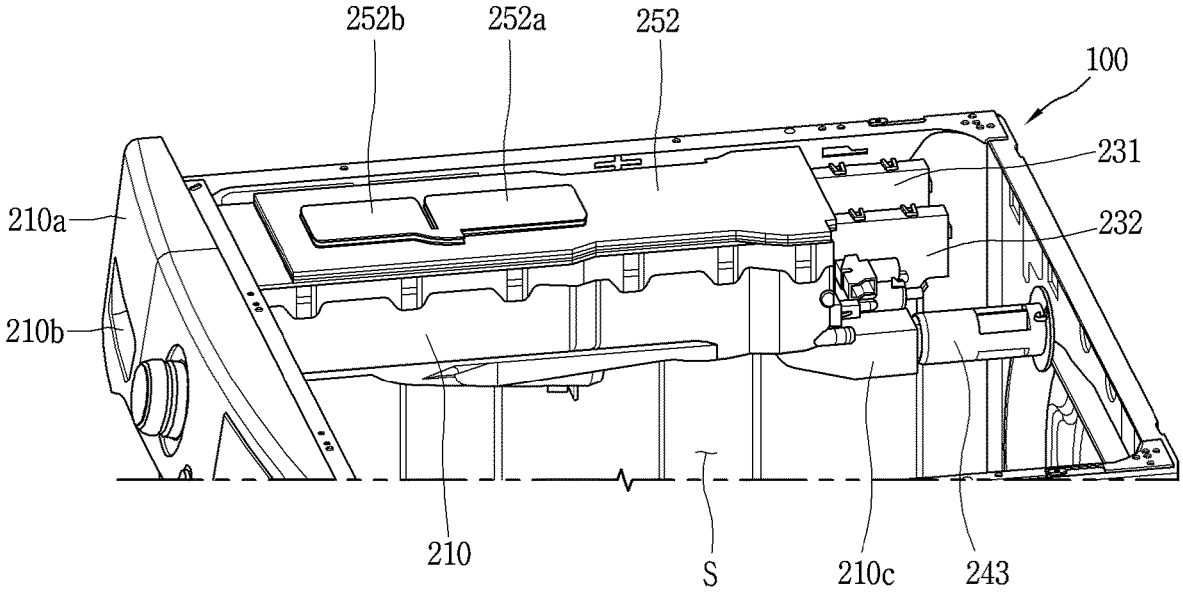
FIG. 4 is a perspective view illustrating an example of an inner upper portion of the laundry treating apparatus.

FIG. 4 is a perspective view illustrating an example of an internal configuration of the laundry treating apparatus 100.

An inner space S may be provided in the laundry treating apparatus 100 by front, rear, and side surfaces of the main body 110 that defines an appearance.

Various components may be accommodated in the inner space S for the laundry treating apparatus 100 to treat laundry. For example, a compressor for a laundry treating process associated with the transfer of heat, such as drying treatment, may be accommodated therein. Furthermore, a tub and a drum inserted into the tub may be provided in the inner space S.

In some examples, a hose member communicating between inside and the outside of the main body 110 may be provided inside the main body 110 so as to allow the inflow of wash water to treat laundry. One side of the hose member may be inserted into the main body 110, and another side of the hose member may be connected to a faucet or the like.

Furthermore, the inside and outside of the main body 110 may be electrically conducted to each other. By the electrical conduction, power for operation may be supplied to the laundry treating apparatus 100.

In some implementations, as shown in FIG. 4, the detergent supply device 200 may be provided in the inner space S. The detergent supply device 200 may be stably supported by a support member 243 coupled to pass through a rear surface of the main body 110.

Figure 5:
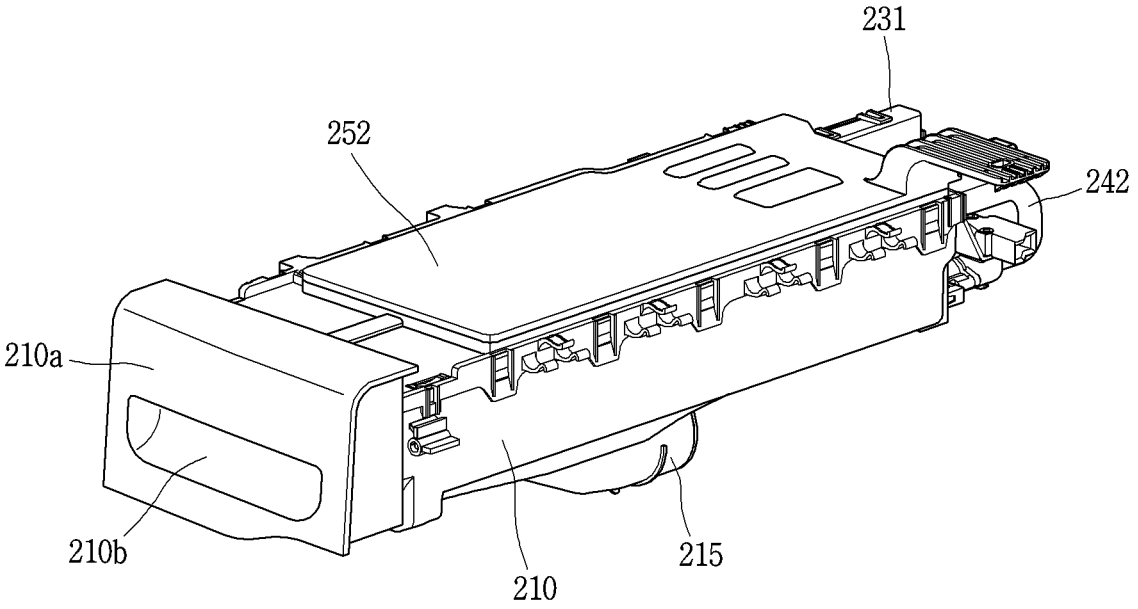
FIG. 5 is a perspective view illustrating an example appearance of the detergent supply device.
Figure 6:
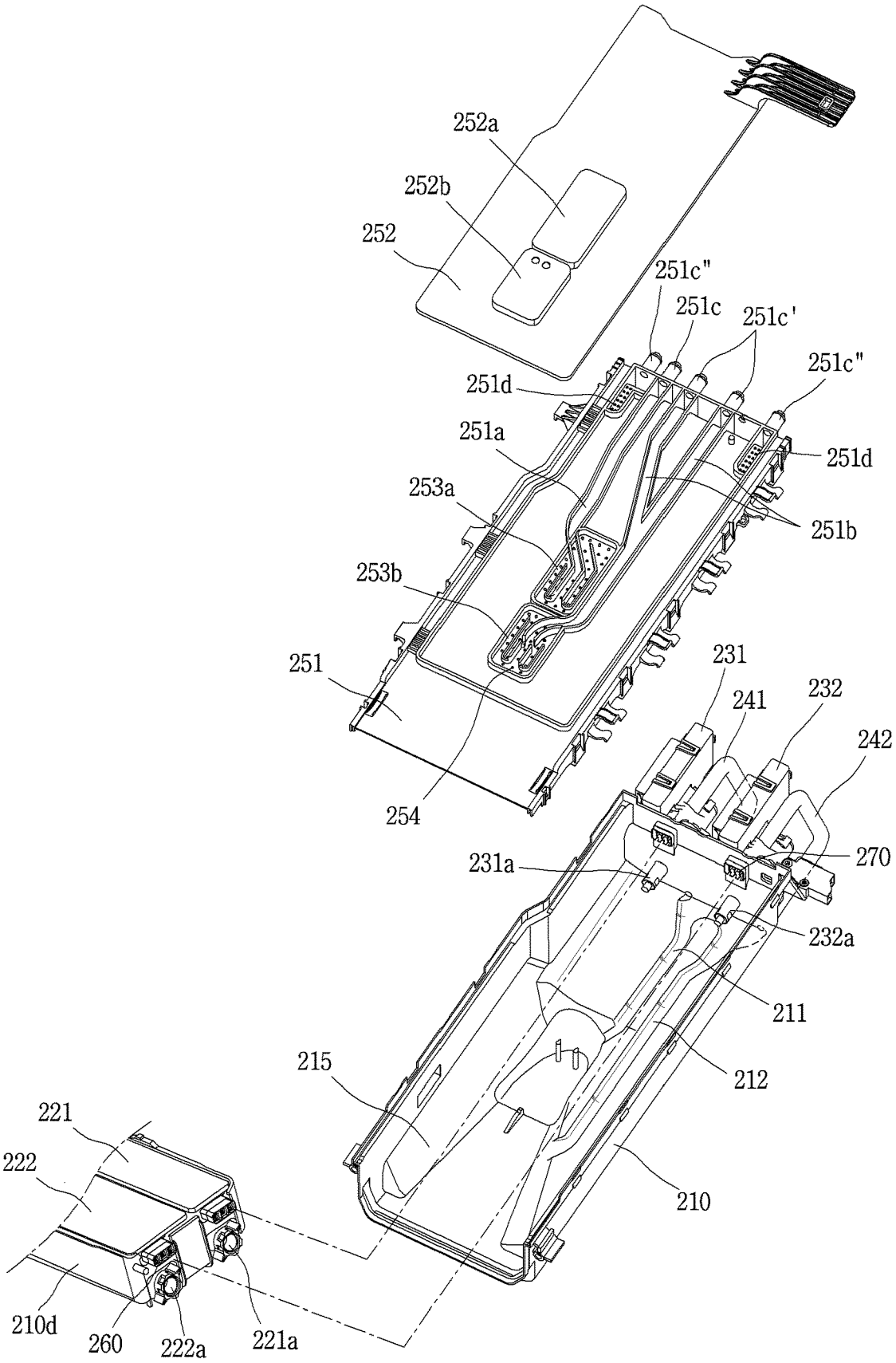
FIG. 6 is an exploded view illustrating the detergent supply device in FIG. 5.
Figure 7:
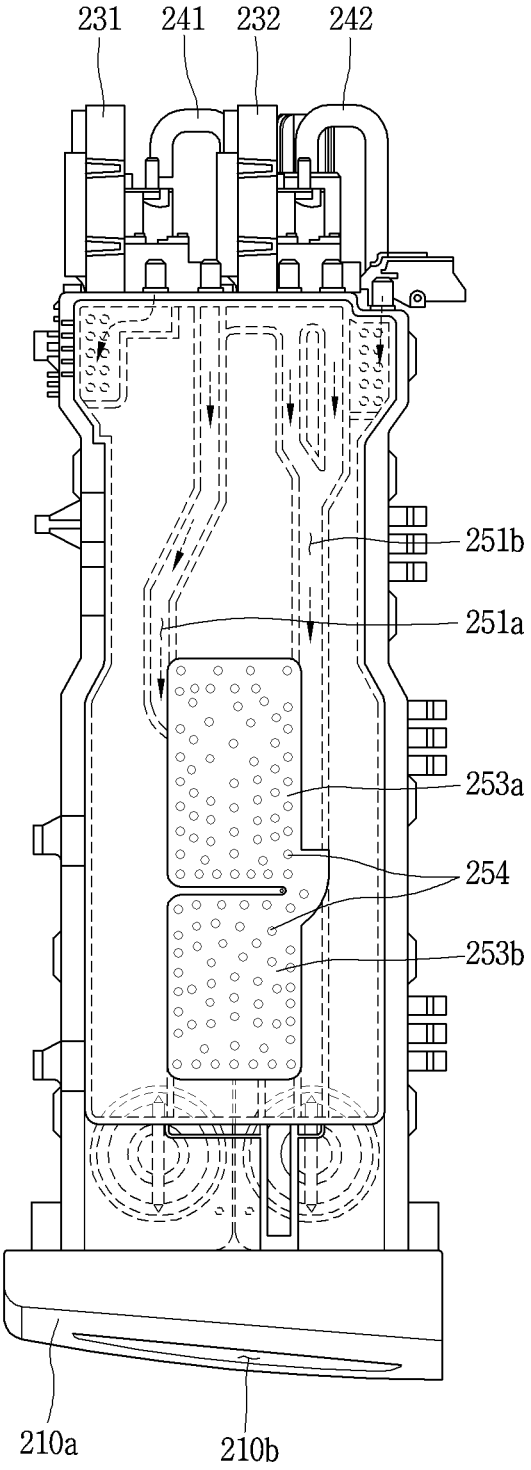
FIG. 7 is a plan view illustrating the detergent supply device.

FIG. 5 is a perspective view illustrating an example appearance of the detergent supply device 200, and FIG. 6 is an exploded view of the detergent supply device 200 in FIG. 5. Furthermore, FIG. 7 is a plan view of the detergent supply device 200.

The detergent supply device 200 may include the housing 210, first and second detergent storage containers 221, 222 mounted on the storage container frame 210*d*, a wash water dispenser 251 and a dispenser cover 252.

The detergent supply device 200 may be connected to the operation unit 113 provided on a front portion of the main body 110 so as to be electrically conducted, and power signals and control signals received through the operation unit 113 may be transmitted to the detergent supply device 200. In some implementations, the detergent supply device 200 may supply an appropriate amount of detergent or softener to the tub according to the received power signals and control signals.

The wash water dispenser 251 may be fixedly provided inside the main body 110, and when the storage container frame 210*d* coupled to each storage container 221, 222 is inserted into the housing 210 located inside the main body 110, as shown in FIG. 5, the wash water dispenser 251 may be located on an upper portion of the housing 210.

The wash water dispenser 251 serves to form a movement path of wash water by introducing wash water from a faucet or the like. When the storage container frame 210*d* is mounted to the housing 210, the wash water dispenser 251 provided inside the main body 110 is located to face each storage container 221, 222 mounted to the storage container frame 210*d*.

The dispenser cover 252 may be coupled to an upper portion of the wash water dispenser 251 to cover the wash water dispenser 251.

The wash water dispenser 251 may be disposed with wash water passages 251*a*, 251*b* extending along a predetermined shape along the surface to guide the movement of wash water flowing in along a wash water inlet portion 251*c*, 251*c'*.

The wash water passages 251*a*, 251*b* may be composed of a first wash water passage 251*a* and a second wash water passage 251*b* that are spaced apart from each other, and a rear surface of the wash water dispenser 251 may be in communication with the wash water inlet portion 251*c*, 251*c'* into which wash water is introduced. For example, the first wash water passage 251*a* may be configured to communicate with a first wash water inlet portion 251*c*, and the second wash water passage 251*b* may be configured to communicate with a second wash water inlet portion 251*c'*.

In some implementations, as shown in FIG. 6, a third wash water inlet portion 251*c''* for supplying wash water may be further disposed on a rear surface of the wash water dispenser 251. Wash water is supplied to the third wash water inlet portion 251*c*", and supplied toward the wash water supply portions 251*d* formed on both side portions of the wash water dispenser 251.

When wash water is supplied to each wash water supply portion 251*d*, the wash water may be discharged through a plurality of holes arranged in each wash water supply portion 251*d* to be supplied to the housing 210. Specifically, the wash water discharged through each wash water supply portion 251*d* may be supplied to a gap disposed between the storage container frame 210*d* (or each laundry detergent storage container 221, 222) and the housing 210, and the wash water flowing out through the gap may move to the housing 210.

As a result, the wash water may be mixed with laundry detergent while flowing in toward a lower surface of the housing 210 to which the laundry detergent is added, and then may move toward the detergent input hole 214.

Each of the wash water passages 251*a*, 251*b* may be disposed along both side walls that protrude and extend constantly. When the dispenser cover 252 is coupled to the wash water dispenser 251, it is defined a closed space allowing wash water to move, and thus wash water may move toward each wash water receiving portion 253*a*, 253*b* along the wash water passage 251*a*, 251*b*.

Each of the wash water passages 251*a*, 251*b* may extend toward each of the wash water receiving portions 253*a*, 253*b* disposed at one side surface of the wash water dispenser 251.

The wash water passage 251*a*, 251*b* may include the first wash water passage 251*a* and the second wash water passage 251*b*. As shown in FIG. 7, the first wash water passage 251*a* may communicate with the first wash water inlet portion 251*c* to flow wash water therein. The first wash water passage 251*a* may serve to guide the movement of the wash water toward a first wash water receiving portion 253*a*.

The first wash water receiving portion 253*a* may be provided with a space in which wash water moving along the first wash water passage 251*a* is accommodated. A plurality of wash water movement holes 254 may be disposed in the first wash water receiving portion 253*a*, and wash water received in the first wash water receiving portion 253*a* may be discharged through the wash water movement holes 254.

Furthermore, the second wash water receiving portion 253*b* may be disposed at a position adjacent to the first wash water receiving portion 253*a* to communicate with the second wash water passage 251*b* so as to accommodate moving wash water.

As shown in FIG. 7, wash water moving along the second wash water passage 251*b* may be accommodated in the second wash water receiving portion 253*b*, and then discharged through the plurality of wash water movement holes 254.

In some implementations, according to the washing process, wash water may be supplied to the third wash water inlet portion 251*c*", and supplied toward the wash water supply portions 251*d* disposed on both side portions of the wash water dispenser 251.

When wash water is supplied to each wash water supply portion 251*d*, the wash water may be discharged through a plurality of holes arranged in each wash water supply portion 251*d* to move to a gap disposed between the storage container frame 210*d* (or each laundry detergent storage container 221, 222) and the housing 210, and then flow in toward a lower surface of the housing 210. Accordingly, wash water may move toward a front portion of the housing while being mixed with the laundry detergent and move to the detergent input hole 214.

The detergent input hole 214 may be disposed at a lower center portion of the housing 210. The detergent input hole 214 may be configured to communicate with the tub of the laundry treating apparatus 100, and thus laundry detergent mixed with wash water may be moved toward the detergent input hole 214 and then supplied to the tub.

Specifically, when the storage container frame 210*d* is inserted into the housing 210 located inside the main body 110, the first wash water receiving portion 253*a* may be located to vertically overlap with the softener housing receiving portion 223 of the housing 210.

Accordingly, fabric softener that is manually added in the softener housing receiving portion 223 or passes through the first laundry detergent passage 211 may be mixed with wash water discharged through the first wash water receiving portion 253*a* and discharged through the detergent input hole 214 to be supplied to the tub.

Likewise, when the storage container frame 210*d* is inserted into the housing 210 provided inside the main body 110, the second wash water receiving portion 253*b* may be located to vertically overlap with the manual detergent dispensing unit 223' of the housing 210.

Accordingly, powder detergent manually supplied by the user or liquid detergent moving along the second laundry detergent passage 212, which will be described later, may be mixed with wash water moving in a downward direction through the plurality of wash water movement holes 254 arranged in the second wash water receiving portion 253*b*, and supplied to the tub through the detergent input hole 214.

The dispenser cover 252 may have a rectangular plate shape, and may be coupled to the wash water dispenser 251. When the dispenser cover 252 is coupled to the wash water dispenser 251, the first and second wash water passages 251*a*, 251*b* disposed in the wash water dispenser 251 may be sealed.

The dispenser cover 252 may be provided to cover the wash water dispenser 251. At this time, one side of the dispenser cover 252 may be disposed with a first wash water receiving protrusion 252*a* and a second wash water receiving protrusion 252*b* to vertically overlap with the first wash water receiving portion 253*a* and the second wash water receiving portion 253*b* disposed at the wash water dispenser 251.

The first wash water receiving protrusion 252*a* and the second wash water receiving protrusion 252*b* are respectively disposed to protrude in an upward direction, to define a movement path of wash water moving along each wash water passage 251*a*, 251*b*.

In some implementations, the detergent supply device 200 may include a residual amount detecting unit 260, and through which, whether or not detergent stored in each detergent storage container 221, 222 is insufficient is detectable. For instance, the residual amount detecting unit 260 may include a sensor, an electrode, or an electric circuit. Details of this will be described later.

Figure 8A:
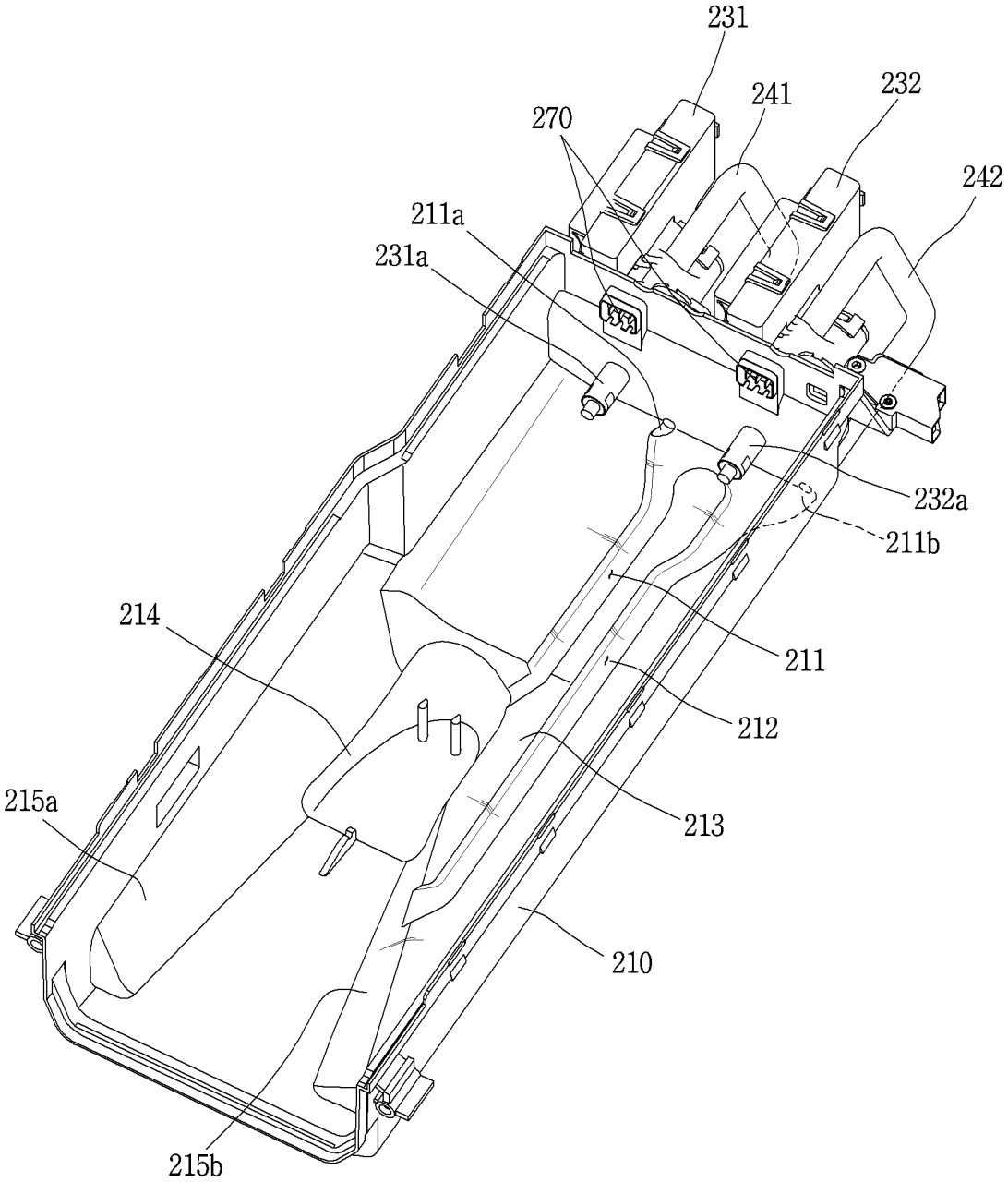
FIG. 8A is a perspective view illustrating an example of a housing of the detergent supply device.
Figure 8B:
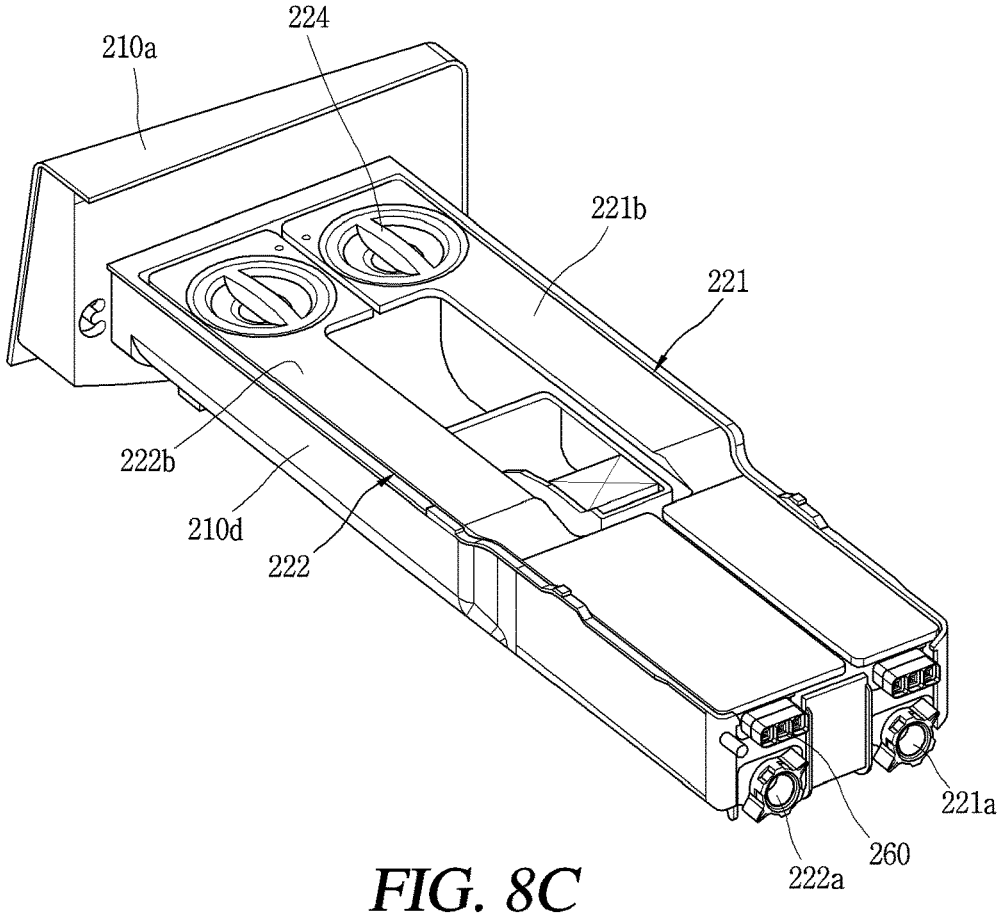
FIG. 8B is a perspective view illustrating examples of a first detergent storage container and a second detergent storage container that are coupled to a storage container frame.
Figure 8C:
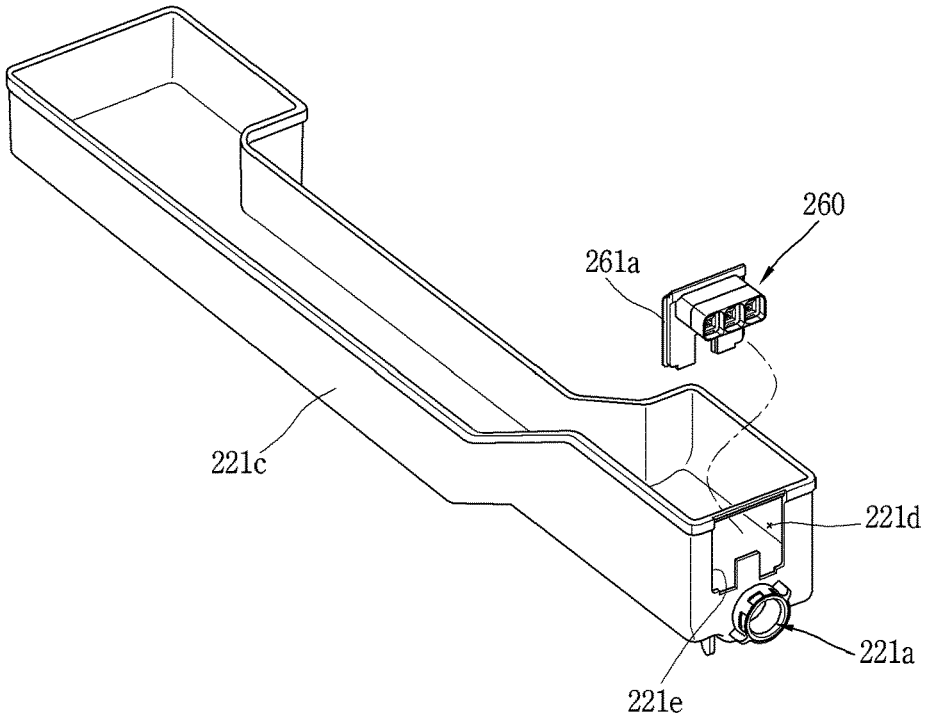
FIG. 8C is a perspective view illustrating an example of an internal appearance of the first detergent storage container drawn out from the storage container frame.
Figure 8D:
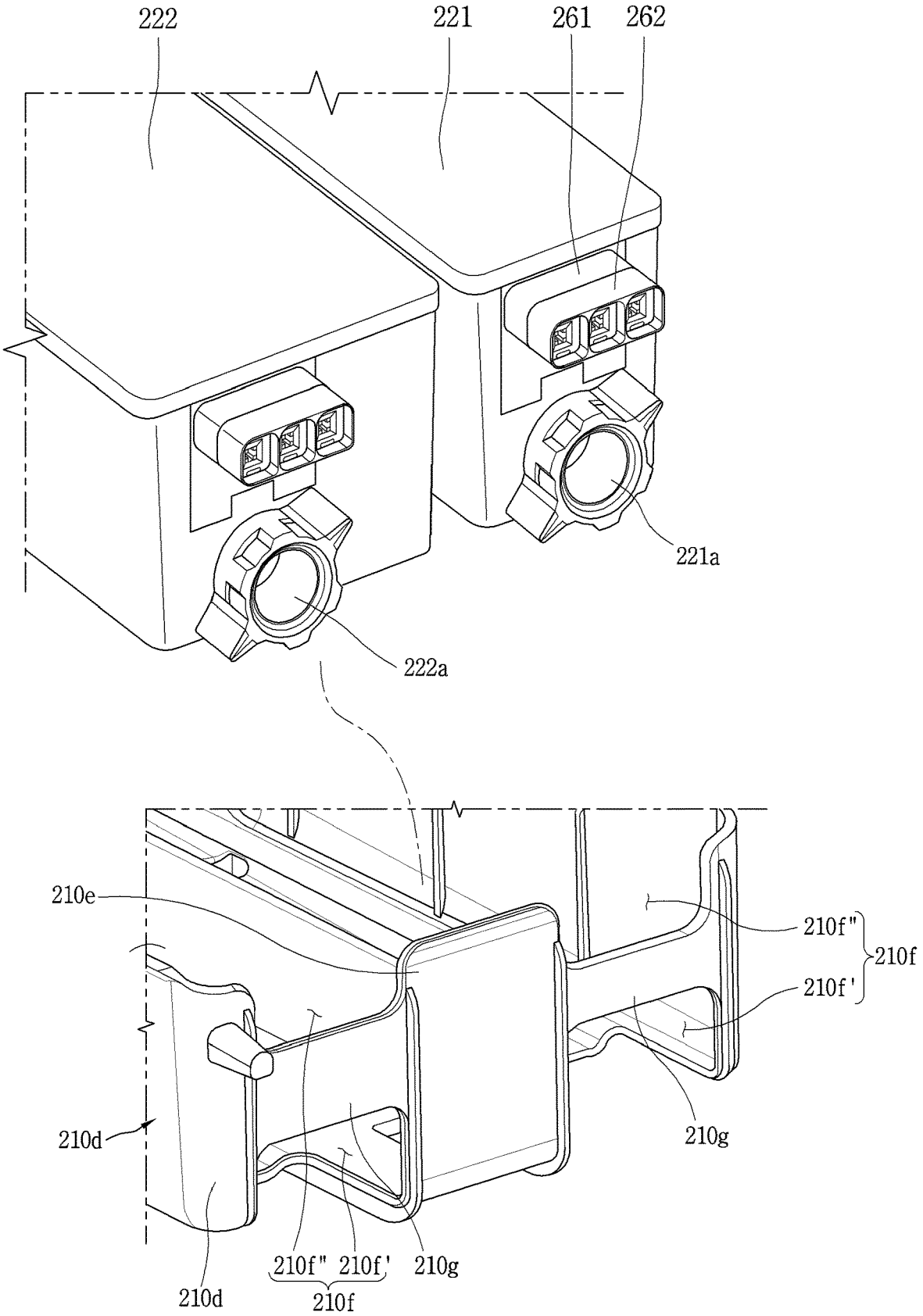
FIG. 8D is a perspective view illustrating an example in which the first detergent storage container and the second detergent storage container are being mounted to the storage container frame.

FIG. 8A is a perspective view illustrating an example of the housing 210 of the detergent supply device 200, FIG. 8B is a perspective view illustrating an example state in which the first detergent storage container 221 and the second detergent storage container 222 are coupled to the storage container frame 210*d*, and FIG. 8C is a perspective view illustrating an example of an internal appearance of the first detergent storage container 221 drawn out from the housing 210. In addition, FIG. 8D is a perspective view illustrating an example state in which the first detergent storage container and the second detergent storage container are being mounted to the storage container frame.

The laundry detergent pumps 231, 232 to allow movements of different laundry detergents, respectively, may be provided at a rear portion of the housing 210.

Detergent stored in each of the detergent storage containers 221, 222 may be discharged through a discharge port provided at a rear surface portion of each detergent storage container 221, 222 by an operation of the laundry detergent pumps 231, 232. The discharged detergent is then introduced into the housing 210, mixed with wash water being introduced into the housing, and finally supplied to the tub.

The laundry detergent pumps 231, 232 serve to generate a transfer force for forming a movement of detergent, and may include a first laundry detergent pump 231 and a second laundry detergent pump 232.

A first laundry detergent suction pipe 231*a* and a second laundry detergent suction pipe 232*b* may be protruded from the inner rear surface portion of the housing 210, respectively.

The first laundry detergent suction pipe 231*a* and the second laundry detergent suction pipe 232*b* may be connected to pump receiving portions 221*a*, 222*a* protruding from the rear portions of the detergent storage containers 221, 222, respectively.

The laundry detergent stored in the first detergent storage container 221 is discharged to a first laundry detergent inlet hole 211*a* via the first laundry detergent suction pipe 231*a*.

Likewise, the laundry detergent stored in the second detergent storage container 222 is discharged to a second laundry detergent inlet hole 211*b* via the second laundry detergent suction pipe 232*b*.

In some implementations, the pump receiving portions 221*a*, 222*a* may protrude at the rear portions of the detergent storage containers 221, 222 toward the laundry detergent pumps 231, 232. The laundry detergent stored in the detergent storage container 221, 222 may move toward the laundry detergent pumps 231, 232 after passing through the pump receiving portions 221*a*, 222*a*. Then, the laundry detergent may pass through the first laundry detergent passage 211 and the second laundry detergent passage 212 to be discharged to the housing 210.

The first laundry detergent pump 231 sucks the laundry detergent stored in the first detergent storage container 221 through the first laundry detergent suction pipe 231*a*, and then discharges the detergent to a first laundry detergent inlet hole 211*a* through a first laundry detergent inlet pipe 241. The laundry detergent discharged through the first laundry detergent inlet hole 211*a* may move along the first laundry detergent passage 211.

Likewise, the second laundry detergent pump 232 sucks the detergent stored in the second detergent storage container 222 through a second detergent suction pipe 231*b*, and then discharges the detergent to a second detergent inlet hole 211*b* through a second detergent inlet pipe 242. The laundry detergent discharged through the second laundry detergent inlet hole 211*b* may move along the second laundry detergent passage 212.

Here, as the first laundry detergent passage 211 and the second laundry detergent passage 212 are spaced apart from each other with a separating wall 213 formed at a lower surface of the housing 210 interposed therebetween, each detergent moving along the first laundry detergent passage 211 and the second laundry detergent passage 212 may be prevented from being mixed with each other.

In some implementations, when wash water is supplied to the wash water supply portion 251*d* provided on both sides of the wash water dispenser 251 by the third wash water inlet portion 251*c*″ (see, FIG. 6), the wash water may be introduced toward the lower surface of the housing 210 while moving along both side walls of the housing 210 into which the laundry detergent is introduced. Accordingly, the wash water will be able to flow toward the detergent input hole 214 after being mixed with the laundry detergent.

In some implementations, as illustrated in FIG. 8A, laundry detergent passages 211, 212 may be extended from the rear portion to the front portion on the lower surface of the housing 210, so that each laundry detergent introduced by the laundry detergent pumps 231, 232 may flow therethrough.

The detergent input hole 214 may be formed in a central portion of the lower surface of the housing 210, and the lower surface of the housing 210 is inclined with a predetermined angle from the rear portion to the front portion. Thus, each detergent may flow smoothly toward the detergent input hole 214.

In some implementations, since the detergent input hole 214 communicates with the tub of the laundry treating apparatus 100, detergent and wash water may be supplied to the tub along the inclined lower surface of the housing 210.

As the laundry detergent passages 211, 212 extend toward the detergent input hole 214, and the detergent input hole 214 communicates with the tub of the laundry treating apparatus 100, the laundry detergent moving along the inclined bottom surface of the housing 210 may be supplied to the tub after passing through the detergent input hole 214 together with the wash water.

The laundry detergent passage 211, 212 may include a first laundry detergent passage 211 that guides the movement of first laundry detergent, and the second laundry detergent passage 212 disposed at a different position by interposing the separating wall 213 therebetween to guide the movement of second laundry detergent.

The separating wall 213 is formed on the lower surface of the housing 210 and may protrude upwardly. By the separating wall 213, the first laundry detergent passage 211 and the second laundry detergent passage 212 may be separated from each other, and the first detergent and the second detergent may be prevented from being mixed with each other.

The separating wall 213 may have a predetermined height, and may extend along a passageway between the first laundry detergent passage 211 and the second laundry detergent passage 212 to face an inclined portion 215*b* from the rear surface of the housing 210.

When detergent and fabric softener are mixed with each other, precipitates may be generated. However, in the present disclosure, a laundry detergent moving through the first laundry detergent passage 211 and a laundry detergent moving through the second laundry detergent passage 212 are not mixed with each other due to the separating wall 213, thereby preventing precipitates from being generated to be stacked up on the lower surface of the housing.

Each laundry detergent passage 211, 212 may be extended to communicate with the laundry detergent inlet hole 211*a*, 211*b* and the detergent input hole 214 disposed on a rear surface of the housing 210, respectively.

By the operation of the laundry detergent pump, first laundry detergent and second laundry detergent flowing from the rear portion of the housing 210 along the laundry detergent passages 211, 212 may move toward the detergent input hole 214.

In some implementations, inclined portions 215*a*, 215*b* having a predetermined inclination in a direction toward the detergent input hole 214 may be formed at one side of the housing 210.

In some implementations, the inclined portions 215*a* 215*b* having a predetermined inclination in a direction toward the detergent input hole 214 may be disposed on both sides of a lower surface of the housing 210, respectively. The inclined portions 215*a*, 215*b* may be formed at both sides with the detergent input hole 214 therebetween, and each detergent moving through the first laundry detergent passage 211 and the second laundry detergent passage 212 may move smoothly toward the detergent input hole 214 by its own weight due to the inclined portions 215*a*, 215*b*.

In other words, the wash water is not only supplied toward a lower portion of the housing 210 to which laundry detergent is added, but also dropped toward the inclined portion 215*b* to be supplied to a peripheral portion of the detergent input hole 214, thereby moving toward the detergent input hole 214 in a state of being well mixed with laundry detergent.

The detergent storage containers 221, 222 may include detergent storage members 221*c*, 222*c* to store laundry detergent, and storage container covers 221*b*, 222*b* to cover each of the detergent storage members 221*c*, 222*c*.

The detergent storage members 221*c*, 222*c* may have a storage space in which an upper portion thereof is opened and laundry detergent is stored therein.

The storage container covers 221*b*, 222*b* are installed to cover the openings of the detergent storage members 221*c*, 222*c* so that the storage spaces in the detergent storage members 221*c*, 222*c* are sealed.

Each of the storage container covers 221*b*, 222*b* is provided with the plug 224, which is rotated in one direction to be detachable from the storage container covers 221*b*, 222*b*, and laundry detergent may be refilled in each of the detergent storage members 221*c*, 222*c*.

In some implementations, as illustrated in FIG. 8C, the residual amount detecting unit 260 is installed at the rear portion of each of the detergent storage containers 221, 222, to detect whether or not the residual amount of the laundry detergent stored in each of the detergent storage members 221*c*, 222*c* is insufficient.

When the first detergent storage container 221 and the second detergent storage container 222 are mounted in the housing 210, the detergent supply device 200 may detect whether or not the residual amount of the detergent stored in each of the detergent storage members is insufficient by the residual amount detecting unit 260. Accordingly, when it is detected that the amount of detergent stored in the detergent storage member is insufficient, the residual amount detecting unit 260 notifies this information to a user, so that user's convenience may be further increased.

For example, when the residual amount of the detergent detected by the residual amount detecting unit 260 is less than a predetermined capacity, a user may withdraw the detergent supply device 200 from the main body, open the plug 224, and then simply refill the detergent.

As illustrated in FIG. 8A, the laundry detergent pumps 231, 232 to form movements of different laundry detergents are installed at the rear portion of the housing 210, and a connection terminal receiving member 270 protrudes toward each of the storage containers 221, 222.

In some implementations, as illustrated in FIG. 8B, a connection terminal portion 262 is coupled to the rear surface of each of the detergent storage containers 221, 222 together with a support bracket 261 to protrude outwardly.

The connection terminal portion 262 may be provided upper than the pump receiving portion 221*a*, 222*a* protruded at the rear portion of the detergent storage container 221, 222. For example, the connection terminal portion 262 and the pump receiving portion 221*a*, 222*a* may be disposed up and down at the rear portion of the detergent storage container 221, 222.

Accordingly, when the detergent storage containers 221, 222 mounted in the storage container frame 210*d* are coupled to the housing 210, the residual amount detecting unit 260 may detect current inside the detergent storage container 221, 222 to detect the residual amount of the detergent stored in the detergent storage container 221, 222.

That is, the residual amount detecting unit 260 is installed at one side of each of the first detergent storage member 221*c* to accommodate the detergent of the first detergent storage container 221 and the second detergent storage member 222*c* to accommodate the detergent of the second detergent storage container 222, to detect the residual amount of the detergent stored in each of the detergent storage members 221*c*, 222*c*.

For example, as illustrated in FIG. 8C, the residual amount detecting unit 260 may be installed at the rear portion of the first detergent storage container 221 pulled out from the storage container frame 210*d*.

Specifically, at one side of the rear surface of the first detergent storage member 221*c*, a coupling portion 221*d* may be formed to penetrate the rear surface, and a mounting groove 221*e* may be recessed along a circumference of the coupling portion 221*d*. An outline of the residual amount detecting unit 260 is positioned to contact the mounting groove 221*e*.

The mounting groove 221*e* may be formed along the circumference of the coupling portion 221*d*. The mounting groove 221*e* serves to guide the mounting protrusion 261*a* formed at the outline of the support bracket 261 to be placed in the mounting groove 221*e*.

As illustrated in FIG. 8D, the first detergent storage container 221 and the second detergent storage container 222 may be mounted to the storage container frame 210*d*.

The storage container frame 210*d* is formed to extend from front to rear, and is configured to accommodate the first detergent storage container 221 and the second detergent storage container 222.

The storage container frame 210*d* has a structure in which a predetermined space is formed by being surrounded by outer walls at front, rear, right, and left sides, and the space is partitioned to form the manual detergent dispensing unit 223' and the softener housing receiving portion 223.

The manual detergent dispensing unit 223' and the softener housing receiving portion 223 may be partitioned by a partition plate 342 installed inside the storage container frame 210*d*.

The outer wall may include a plurality of planes, and the plurality of planes may extend from the front side to the rear side while having a predetermined angle with each other. Here, a width of the space surrounded by the outer walls, that is, a width in a left-right direction may be different in a longitudinal direction, that is, in a front-rear direction.

A rear end of the storage container frame 210*d* may be roundly bent, and partially support a rear end of the detergent storage container 221, 222 inserted into the storage container frame 210*d*.

A rear wall 210*e* is positioned in a space between the bent portions. A space between the bent portion and the rear wall 210*e* may have a communication portion 210*f*. Here, the bent portion may be connected to the rear wall 210*e* by a partition member 210*g*. That is, both outer walls facing the rear wall 210*e* may be connected by the partition member 210*g*.

In some implementations, a distance-limited protrusion may be formed at the bent portion. The distance-limiting protrusion protrudes a predetermined distance from an upper side of the bent portion of the outer wall.

The distance limiting protrusion serves to limit an insertion distance by being in contact with the laundry detergent pump 231, 232 or others when the storage container frame 210*d* is inserted into the housing 210. The rear wall 210*e* forms one side in a longitudinal direction of the storage container frame 210*d*, that is, a rear side outer circumference, for example. The rear wall 210*e* supports the rear side of the detergent storage container 221, 222.

The rear wall 210*e* may extend upwardly while having a predetermined angle with a bottom surface of the storage container frame 210*d*.

By openings 210*f'* and 210*f''* formed by the rear wall 210*e*, the residual amount detecting unit 260 provided in the detergent storage container 221, 222, and the pump receiving portion 221*a*, 222*a* may protrude to the rear side by a predetermined distance.

The pump receiving portion 221*a*, 222*a* may protrude toward the laundry detergent pump 231, 232 at the rear portion of the detergent storage container 221, 222. The laundry detergent stored in the detergent storage container 221, 222 may flow toward the laundry detergent pump 231, 232 after passing through the pump receiving portion 221*a*, 222*a*. Then, the laundry detergent may pass through the first laundry detergent passage 211 and the second laundry detergent passage 212 to be discharged toward the housing 210.

The rear wall 210*e* may be connected by the partition member 210*g*. The partition member 210*g* may divide the opening 210*f'*, 210*f''* into a pump receiving opening 210*f'* and a residual amount detecting unit opening 210*f''*.

The communication portion 210*f* is a portion in which one side of the detergent storage container 221, 222 inserted in the storage container frame 210*d*. For example, the rear side in the illustrated implementations may communicate with an outside of the storage container frame 210*d*. The residual amount detecting unit 260 and the pump receiving portion 221*a*, 222*a* provided at the rear side of the detergent storage container 221, 222 may be exposed to the outside through the communication portion 210*f*.

That is, as the communication portion 210*f* is formed at the rear portion of the storage container frame 210*d*, the residual amount detecting unit 260 provided in the detergent storage container 221, 222 may be electrically connected to an external controller.

The communication portion 210*f* is located at one side in the longitudinal direction of the storage container frame 210*d*. For example, the communication portion 210*f* may be located at the rear side as illustrated.

The partition member 210*g* serves to partition the opening 210*f'*, 210*f''* into the pump receiving opening 210*f'* at a lower side and the residual amount detecting unit opening 210*f''* at an upper side.

The partition member 210*g* may serve to reinforce a rigidity of a structure at the rear side of the storage container frame 210*d* by connecting the outer wall and the rear wall 210*e* of the storage container frame 210*d*.

In some implementations, the partition member 210*g* may limit an insertion direction and a separation direction of the detergent storage container 221, 222 by partitioning the opening into the pump receiving opening 210*f'* and the residual amount detecting unit opening 210*f''*.

The pump receiving opening 210*f'* is a space through which the pump receiving portion 221*a* passes. By the pump receiving opening 210*f*, a pump valve of the laundry detergent pump 231, 232 may be coupled to communicate with the pump receiving portion 221*a*.

The pump receiving opening 210*f'* may be located below the residual amount sensor opening 210*f''*, and the residual amount sensor opening 210*f''* may be located above the pump receiving opening 210*f'*.

As an opening 332 is partitioned into the pump receiving opening 210*f'* and the residual amount sensor opening 210*f''* by the partition member 210*g*, the insertion and separation directions of the detergent storage container 221, 222 may be limited.

That is, the residual amount detection sensor 260 is firstly inserted into the residual amount detection sensor opening 210*f''*, and then check valves 416, 426 are inserted into the pump receiving opening 210*f'*. In some cases, the check valves 416, 426 are firstly separated from the pump receiving opening 210*f'*, and then the residual amount detecting unit 260 is separated from the residual amount sensor opening 210*f*.

Figure 9A:
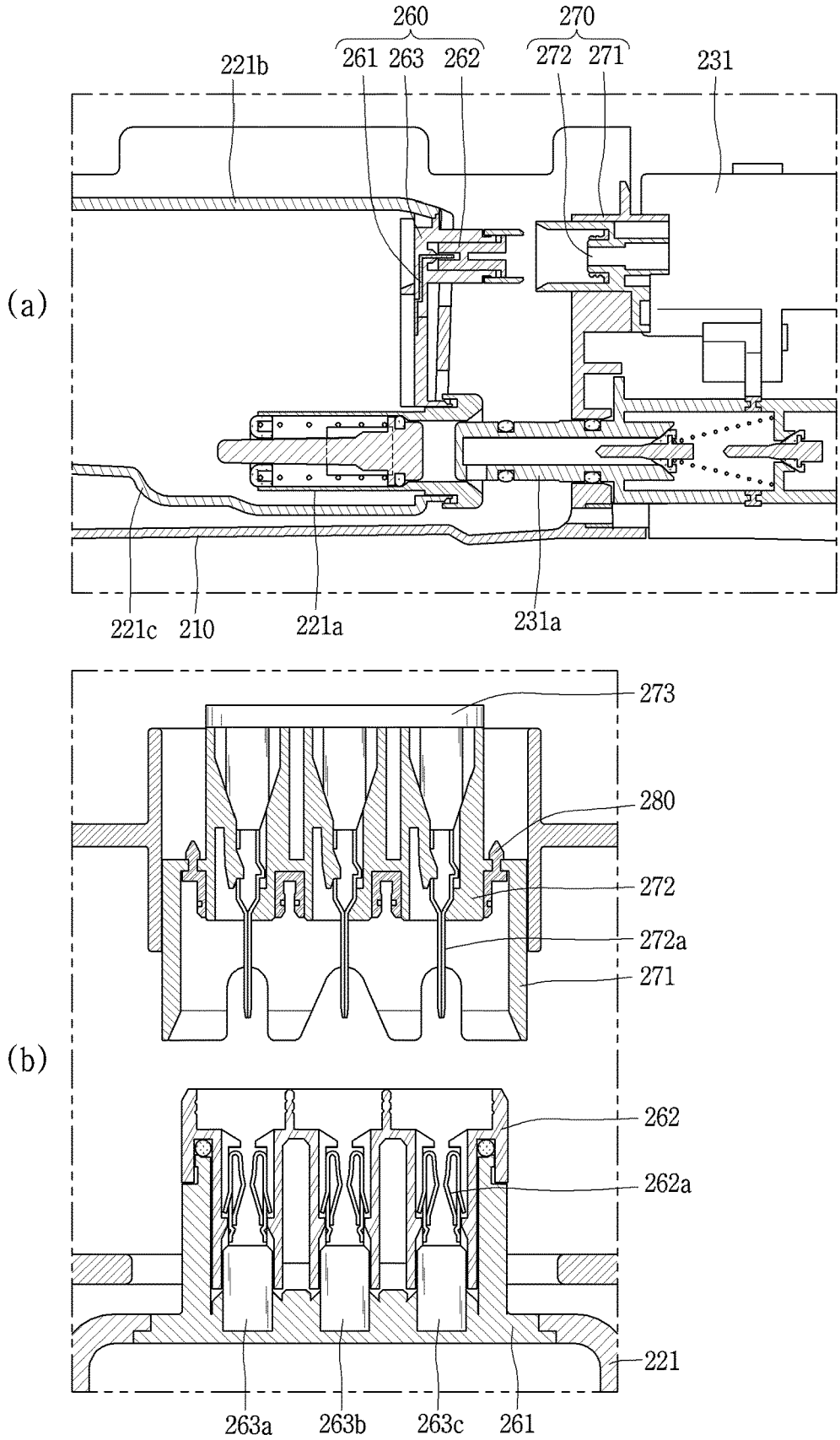
FIG. 9A is a sectional view illustrating an example state before the first detergent storage container is mounted to the housing.
Figure 9B:
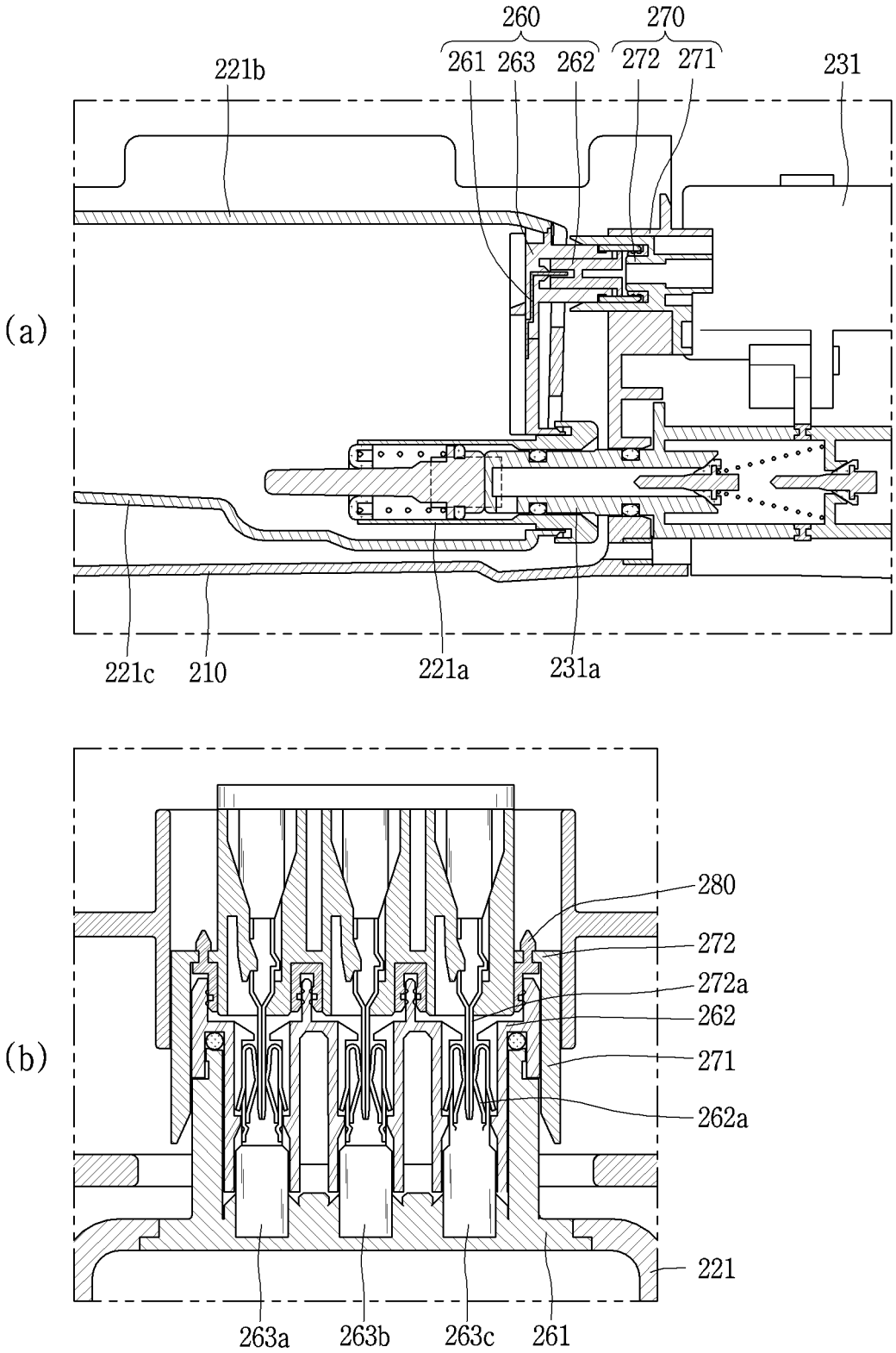
FIG. 9B is a sectional view illustrating an example state after the first detergent storage container is mounted to the housing.

FIG. 9A is a sectional view illustrating a state before the first detergent storage container 221 is mounted to the housing 210, and FIG. 9B is a sectional view illustrating a state after the first detergent storage container 221 is mounted to the housing 210.

FIGS. 9A and 9B illustrate example states in which the residual amount detecting unit 260 is being installed to detect the residual amount of the detergent in the first detergent storage container 221. However, for the second detergent storage container 222 as well as for the first detergent storage container 221, the residual amount of the detergent may be equally applied.

The residual amount detecting unit 260 may be operated in a state where the storage container frame 210*d* equipped with the detergent storage containers 221, 222 is completely inserted into the housing 210, and the detergent supply device 200 is mounted to the main body of the laundry treating apparatus 100. The residual amount detecting unit 260 may detect the residual amount of the detergent stored in each of the detergent storage container 221, 222 by applying a current into each of the detergent storage containers 221, 222, then measuring the current.

The residual amount detecting unit 260 may be installed in each of the first detergent storage container 221 and the second detergent storage container 222. The residual amount detecting unit 260 may detect whether the residual amount of the detergent stored in the first detergent storage member 221*c* and the second detergent storage member 222*c* is insufficient in a state in which the housing 210 is coupled to each of the detergent storage containers 221, 222.

The residual amount detecting unit 260 may include the support bracket 261, the connection terminal portion 262, the electrode 263, and the connection terminal receiving member 270.

The support bracket 261 may be configured to be coupled to the rear surface of each of the detergent storage containers 221, 222. The support bracket 261 may be coupled to the rear surfaces of the first and second detergent storage members 221*c*, 222*c* by bonding.

In some examples, as illustrated in (a) and (b) of FIG. 9A, one surface of the support bracket 261 is accommodated in an inner space of the first detergent storage member 221*c*, and another surface of the support bracket 261 protrudes outwardly of the first detergent the storage member 221*c*.

The electrode 263 may be provided inside the support bracket 261.

The electrode 263 may be installed such that at least a portion thereof is exposed to the inside of the first detergent storage member 221*c* so as to be in contact with the laundry detergent stored in the first detergent storage member 221*c*.

The electrode 263 is made of a metal material and has a structure capable of applying an electric current. The electrode 263 may be coupled into the support bracket 261 in a manner such as an insert-molding.

Here, the electrode 263 is in a state where at least a part thereof is exposed to the outside. Another part of the electrode 263 may be exposed to the inside of the first detergent storage member 221*c* so as to be brought into contact with the laundry detergent stored in the first detergent storage container 221.

When one side of the electrode 263 exposed to the first detergent storage member 221*c* is brought into contact with the stored detergent, a current may be passed through the laundry detergent, so that the residual amount of the detergent is detected.

Here, the connection terminal portion 262 may be fitted to an outer portion of the support bracket 261. The connection terminal portion 262 is coupled with the connection terminal receiving member 270 so that the residual amount detecting unit 260 is in a state ready to be operated.

The connection terminal receiving member 270 may be connected to the laundry detergent pump 231, 232, and be installed to face each of the detergent storage containers 221, 222. When the connection terminal portion 262 is inserted into the connection terminal receiving member 270, they may be electrically connected to each other.

In some implementations, as illustrated in (a) and (b) of FIG. 9B, a connection pin receiving member 262*a* is installed inside the connection terminal portion 262. When the connection terminal portion 262 is inserted into the connection terminal receiving member 270, a connection pin 272*a* of the connection terminal receiving member 270 is inserted toward the connection pin receiving member 262*a* installed inside the connection terminal portion 262. Here, the residual amount detecting unit 260 may detect the residual amount of the detergent and whether the residual amount of the detergent is insufficient by measuring a current value using the laundry detergent stored in each of the detergent storage containers 221, 222 as a medium.

The connection terminal receiving member 270 may include a connection terminal housing 271 and a connection terminal 272.

The connection terminal housing 271 defines an appearance and may be fixed to the housing 210.

Here, the connection terminal 272 is fixedly installed inside the connection terminal housing, and when the connection terminal portion 262 is inserted, the connection terminal portion 262 and the electrode 263 are electrically connected to each other. The connection pin 272*a* is fixedly installed inside the connection terminal 272, and the connection pin 272*a* may protrude toward the connection pin receiving member 262*a* so as to be inserted into or withdrawn from the connection pin receiving member 262*a*.

Figure 10A:
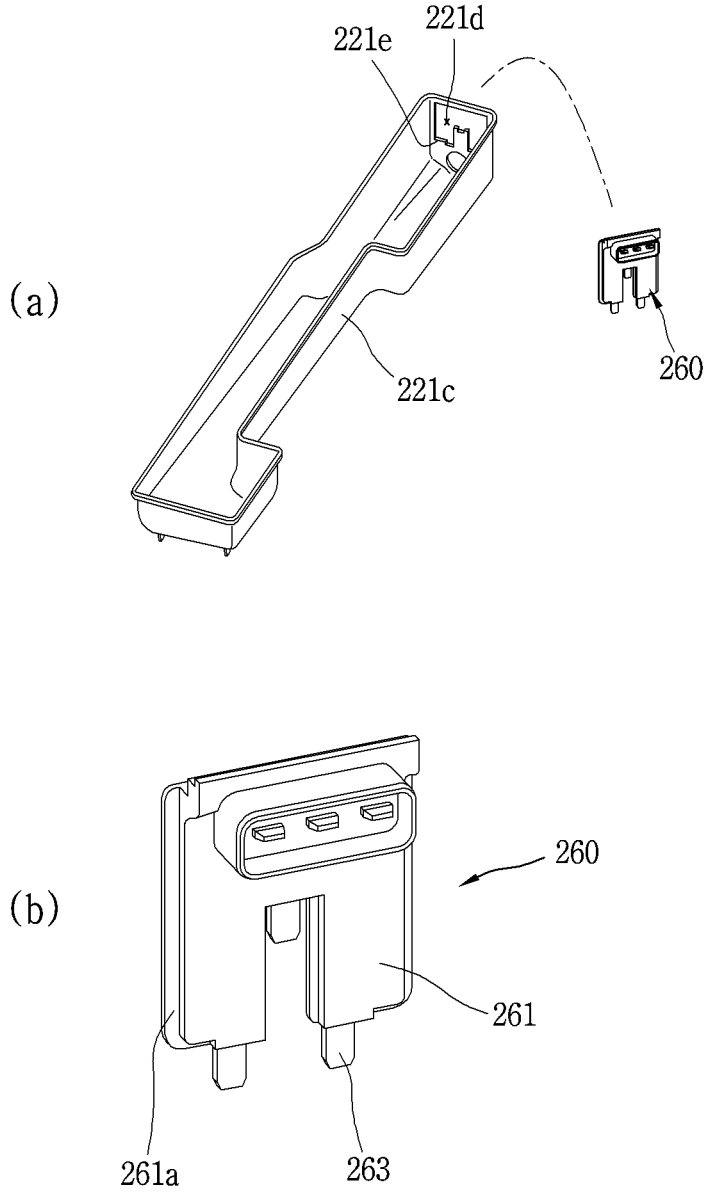
FIG. 10A illustrates an example of a support bracket; (a) of FIG. 10A is a conceptual view illustrating the support bracket; (b) of FIG. 10A is a perspective view of the support bracket.
Figure 10B:
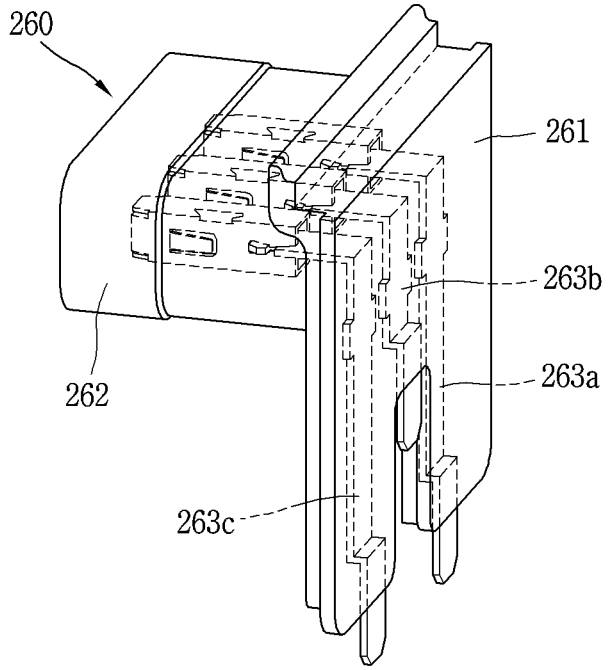
FIG. 10B illustrates an example of a residual amount detecting unit; (a) of FIG. 10B is a perspective view illustrating the residual amount detecting unit; (b) of FIG. 10B is a perspective view illustrating examples of an electrode sensor terminal and an electrode; (c) of FIG. 10B is a conceptual view illustrating an example state in which the electrode sensor terminal and the electrode are being coupled.
Figure 10B:
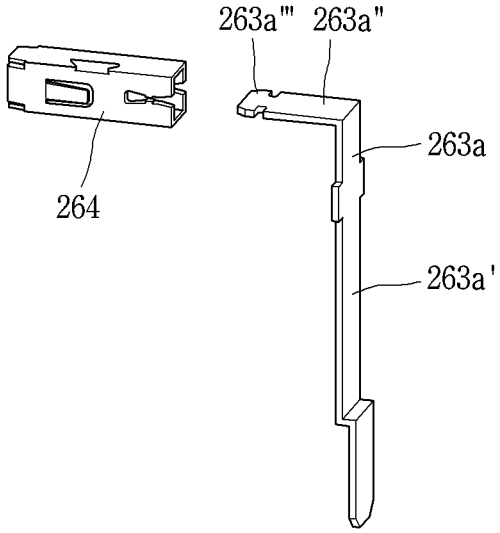
Figure 10B:
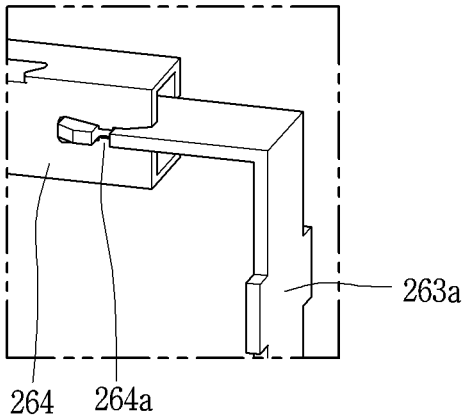

(a) of FIG. 10A illustrates an example of the support bracket 261 to be coupled to the detergent storage container 221, 222, and (b) of FIG. 10A is a perspective view of the support bracket 261. In addition, (a) of FIG. 10B is a perspective view illustrating the residual amount detecting unit 260, (b) of FIG. 10B is a perspective view illustrating examples of an electrode sensor terminal 264 and the electrode sensor 263*a*, and (c) of FIG. 10B is a conceptual view illustrating an example state in which the electrode sensor terminal 264 and the electrode sensor 263*a* are being coupled.

The residual amount detecting unit 260 is operated in a state in which each of the detergent storage containers 221, 222 is coupled to the housing 210.

The residual amount detecting unit 260 may detect the residual amount of the detergent stored in each of the detergent storage container 221, 222 by applying a current of a set magnitude into the detergent storage member 221*c*, 222*c* then measuring the current detected by the electrode sensor.

The residual amount detecting unit 260 may be installed in each of the first detergent storage container 221 and the second detergent storage container 222, and may detect the residual amount of the detergent stored in the first detergent storage container 221 and the second detergent storage 222.

Here, whether the residual amount of the detergent in the first detergent storage container 221 is insufficient and whether the residual amount of the detergent in the second detergent storage container 222 is insufficient may be detected in a same manner by the residual amount detecting unit 260.

The residual amount detecting unit 260 may include the support bracket 261, the connection terminal portion 262, the electrode 263, and the connection terminal receiving member 270.

The support bracket 261 may be coupled to the rear surfaces of each of the first and second detergent storage members 221*c*, 222*c* by bonding. Here, one surface of the support bracket 261 is accommodated in the inner space of each of the detergent storage members 221*c*, 222*c*, and another surface protrudes outwardly of each of the detergent storage members 221*c*, 222*c*.

The mounting protrusion 261*a* is formed at the outline of the support bracket 261, and the mounting protrusion 261*a* may be placed in the mounting groove 221*e* which is recessed along the circumference of the coupling portion 221*d* of each detergent storage member 221*c*, 222*c*. Accordingly, the support bracket 261 may be more easily coupled to each of the detergent storage members 221*c*, 222*c*.

A plurality of electrodes 263 may be installed inside the support bracket 261.

The support bracket 261 may be coupled to the detergent storage container 221, 222 at one side of the rear surface of the detergent storage container 221, 222, and at least a part of the electrode 263 coupled to the support bracket 261 through insert-injection may be located inside the first and second detergent storage members 221*c*, 222*c*.

The electrode 263 may be configured in plural, and at least one electrode sensor may have a different length. Each of the electrode sensors 263*a*, 263*b*, 263*c* may have different heights from the lower surface of the detergent storage members 221*c*, 222*c*. With this structure, the electrode 263 and the laundry detergent in the detergent storage member 221*c*, 222*c* may be selectively contacted so that the residual amount of the laundry detergent is smoothly detected.

That is, the electrode 263 is positioned such that at least a portion thereof is exposed inside the first detergent storage container 221, thereby brought into contact with the laundry detergent stored in the first detergent storage member 221*c*. When the electrode 263 is brought into contact with the laundry detergent in the first detergent storage member 221*c*, a current may be passed through the detergent, so that the residual amount of the detergent stored in the first detergent storage container 221 is detected.

In a manner same as the above, the electrode 263, located such that at least a part thereof is exposed inside the second detergent storage container 222, is brought into contact with the detergent stored in the second detergent storage member 222*c*, the residual amount of the detergent stored in the second detergent storage container 222 may be detected.

Inside the connection terminal portion 262, the electrode sensor terminal 264 to support the electrode 263 and to transmit electrical signals may be installed. Inside the electrode sensor terminal 264, the connection pin receiving member 262*a* may be protruded.

When the connection terminal portion 262 is inserted into the connection terminal receiving member 270, the connection pin 272*a* of the connection terminal receiving member 270 is inserted toward the connection pin receiving member 262*a* installed inside the connection terminal portion 262. Here, the residual amount detecting unit 260 may detect the residual amount of the detergent by a current value using the laundry detergent stored in each of the detergent storage containers 221, 222 as a medium.

As illustrated in FIG. 10B, the electrode 263 may include a horizontal portion 263*a*″ to be fixed to the electrode sensor terminal 264 and a vertical portion 263*a*′ bent from the horizontal portion 263*a*″ and extending in a direction intersecting with the horizontal portion 263*a*″.

The horizontal portion 263*a*″ and the vertical portion 263*a*′ may be formed in a direction intersecting each other.

One end of the horizontal portion 263*a*″ may be formed with a fitting protrusion 263‴ protruding outwardly so that it may be fixed by being fitted into protrusion grooves formed on both sides of the electrode sensor terminal 264.

In some implementations, the vertical portion 263*a*′ may extend toward the interior of the detergent storage containers 221, 222, and one end thereof may be exposed inside the detergent storage containers 221, 222.

Hereinafter, description will be given of a method for detecting the residual amount of the laundry detergent stored in the detergent storage containers 221, 222 by the residual amount detecting unit 260.

As described above, the electrode 263 may be configured in plural. The electrode 263 configured in plural may be configured such that at least one electrode has a different length. For example, the electrode 263 may have a total of three electrode sensors, that is, the first electrode sensor 263*a*, the second electrode sensor 263*b*, and a third electrode sensor 263*c*, as illustrated in FIG. 10B.

Here, a length of the first electrode sensor 263*a* and a length of the third electrode sensor 263*c* may be identical. The second electrode sensor 263*b* may be located between the first electrode sensor 263*a* and the third electrode sensor 263*c*, and has a length shorter than that of the first and third electrode sensors 263*a*, 263*c*.

A length of a vertical portion of the first and third electrode sensors 263*a*, 263*c* may be longer than a length of a vertical portion of the second electrode sensor 263*b*.

For example, when a sufficient amount of laundry detergent is stored in the first detergent storage container 221, the first electrode sensor 263*a* and the third electrode sensor 263*c* are brought into contact with the laundry detergent. Here, the first electrode sensor 263*a* and the third electrode sensor 263*c* are electrically connected through the laundry detergent, and the controller may determine that a predetermined amount of laundry detergent is stored in the first detergent storage container 221 by the sensed current value.

In some cases, when an insufficient amount of laundry detergent is stored in the first detergent storage container 221 so that a level of the laundry detergent is lower than the positions of the first electrode sensor 263*a* and the third electrode sensor 263*c*, the first electrode sensor 263*a* and the third electrode sensor 263*c* are not brought into contact with the laundry detergent and therefore a current may not pass through the laundry detergent. Here, since there is no current value sensed by the controller, the controller may generate and output a signal indicating that the amount of laundry detergent stored in the first detergent storage container 221 is less than the predetermined level and needs a refill of laundry detergent.

Likewise, when a sufficient amount of laundry detergent is stored in the first detergent storage container 221, and the first electrode sensor 263*a* and the third electrode sensor 263*c*, as well as the second electrode sensor 263*b*, are brought into contact with the laundry detergent, the controller may generate a signal indicating that a sufficient amount of laundry detergent is stored in the first detergent storage container 221 according to the sensed current value, and output the signal to the outside.

In some implementations, according to a state in which the laundry detergent is in contact with or not in contact with each of the electrode sensors 263*a*, 263*b*, 263*c*, whether the residual amount of laundry detergent stored in each of detergent storage containers 221, 222 is greater than or less than a reference amount will be automatically detected. In addition, the user's convenience may be further expanded by notifying the user of the residual amount of the stored laundry detergent.

Figure 11A:
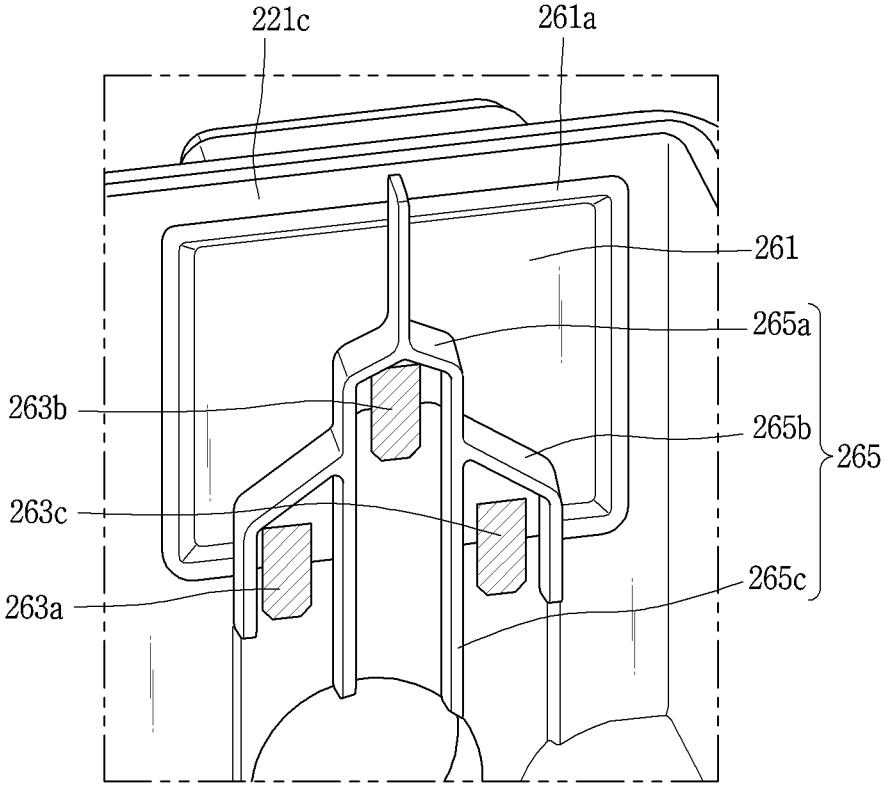
FIG. 11A is a perspective view illustrating one side of the support bracket.
Figure 11B:
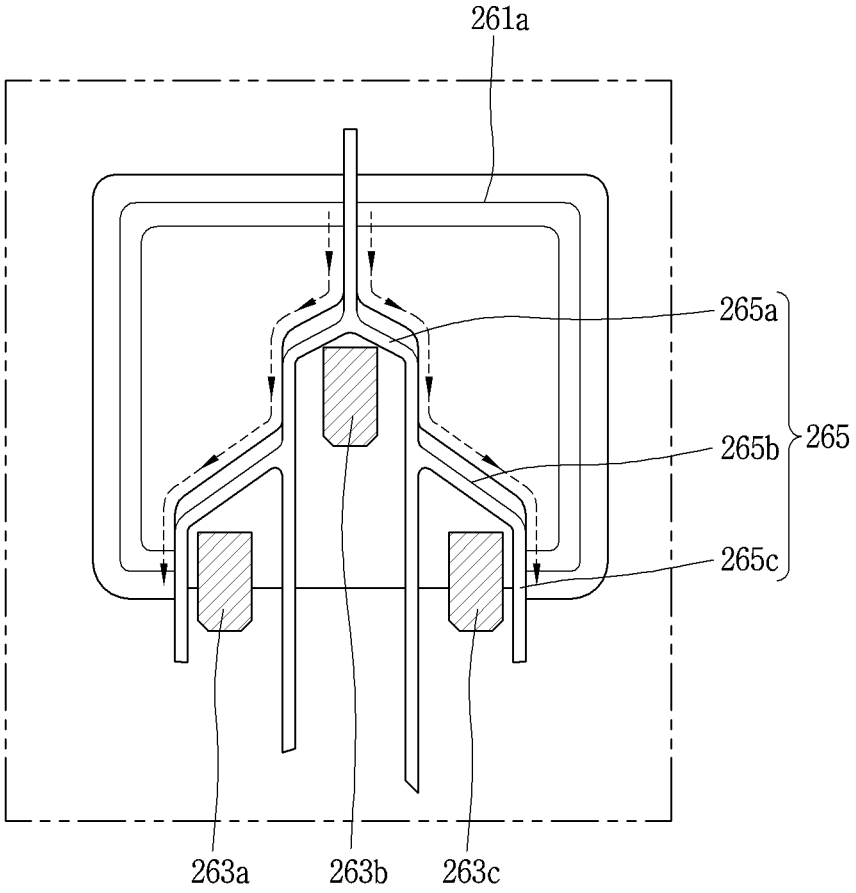
FIG. 11B is a conceptual view illustrating an example in which laundry detergent is moving at one side of the support bracket.

FIG. 11A is a perspective view illustrating an example of one side of the support bracket 261, and FIG. 11B is a conceptual view illustrating an example state in which laundry detergent is moving at one side of the support bracket 261.

As described above, a support bracket 261 may be coupled to the rear surfaces of the first and second detergent storage members 221*c*, 222*c*, and the electrode 263 installed on the support bracket 261 may detect the residual amount of the laundry detergent stored in the first and second detergent storage members 221*c*, 222*c*.

However, when the laundry detergent is brought into contact with the electrode 263 exposed from the support bracket 261, the residual amount detecting unit may falsely detect that there is a sufficient amount of laundry detergent in the detergent storage containers 221, 222. In some implementations, at one surface of the support bracket 261, that is, at one surface located inside the first and second laundry detergent storage members 221*c*, 222*c*, a detergent blocking rib 265 may be protruded in a shape surrounding one side of the exposed electrode 263.

As illustrated in FIG. 11A, the detergent blocking rib 265 serves to partition the first electrode sensor 263*a*, the second electrode sensor 263*b*, and the third electrode sensor 263*c*. Accordingly, when the laundry detergent is left on one surface of the support bracket or residual laundry detergent remains, the detergent blocking rib 265 prevents the laundry detergent from moving toward each of the electrode sensors 263*a*, 263*b*, 263*c*, thereby preventing the residual amount detecting unit 260 from malfunctioning.

Here, the detergent blocking rib 265 may include a boundary portion 265*c* configured to partition the first electrode sensor 263*a*, the second electrode sensor 263*b*, and the third electrode sensor 263*c*.

In some implementations, since the detergent blocking rib 265 is to prevent malfunction of the electrode sensor, the detergent blocking rib 265 may include blocking portions 265*a*, 265*b* inclined in a vertical direction.

The blocking portions 265*a*, 265*b* may have a predetermined inclination in the vertical direction. The blocking portions 265*a*, 265*b* may be provided at a plurality of locations to have different heights. The blocking portions 265*a*, 265*b* may include protrusions that protrude from a surface of the support bracket 261.

The blocking portions 265*a*, 265*b* serve to guide a movement of the laundry detergent that drops from one surface of the support bracket 261, as illustrated in FIG. 11B, to limit the laundry detergent from moving toward the electrode sensors 263*a*, 263*b*, 263*c*.

Figure 12:
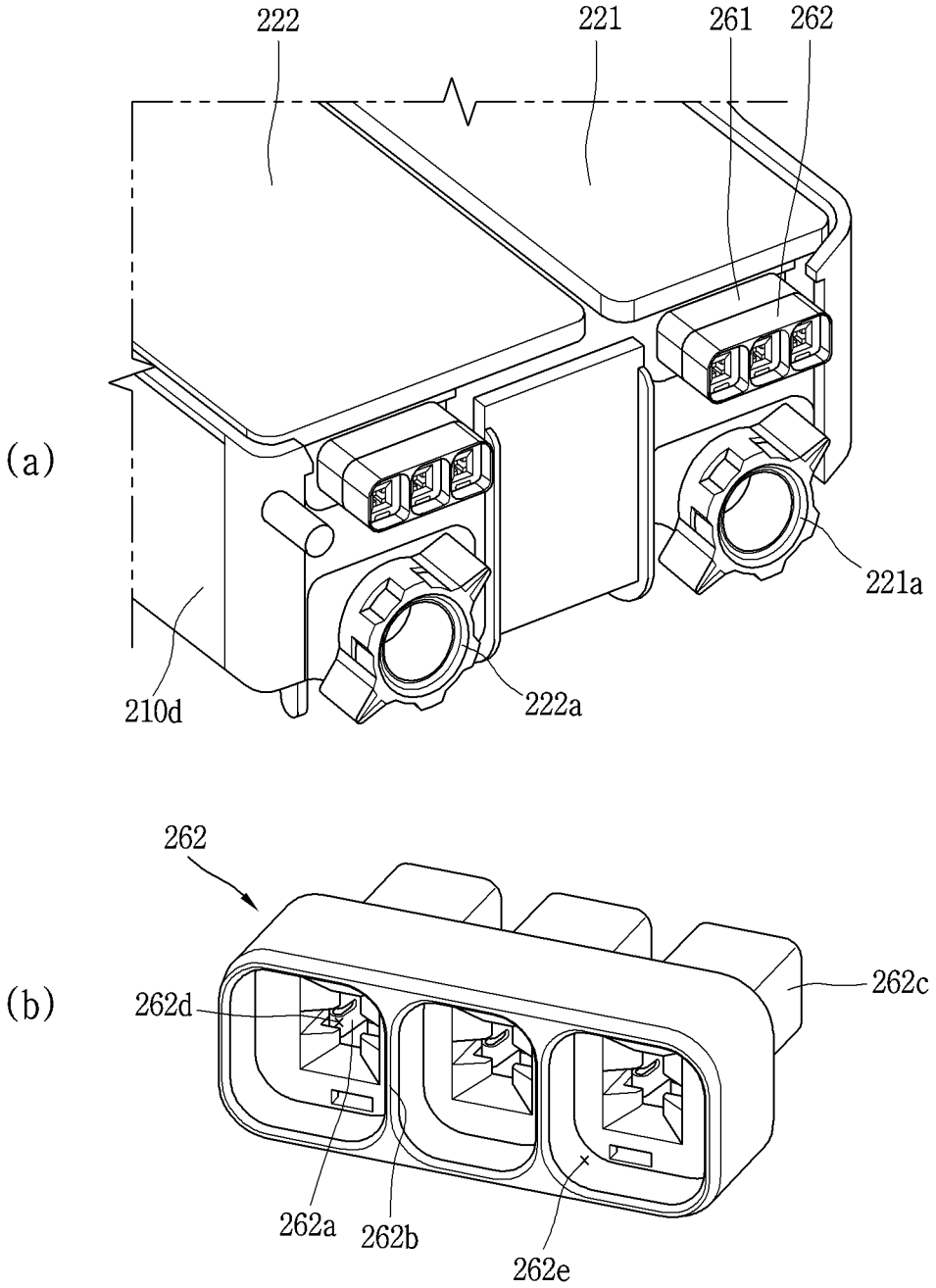
FIG. 12 illustrates the storage container; (a) of FIG. 12 is a perspective view illustrating an example of a rear side of the storage container; (b) of FIG. 12 is a perspective view illustrating an example of a connection terminal portion.
Figure 13:
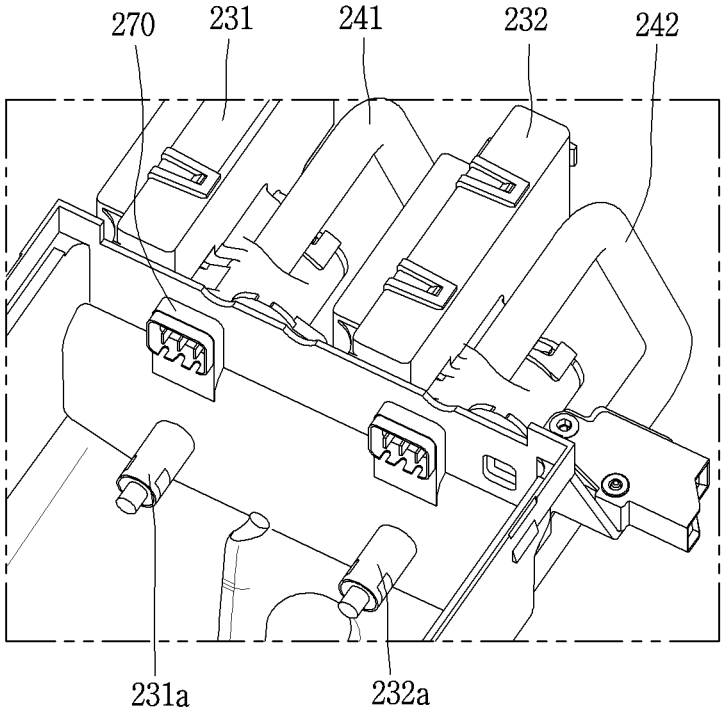
FIG. 13 illustrates an example of a laundry detergent pump; (a) of FIG. 13 is a perspective view illustrating an example state in which the laundry detergent pump is coupled to the housing; (b) of FIG. 13 is a perspective view illustrating an example of a connection terminal receiving member.
Figure 13:
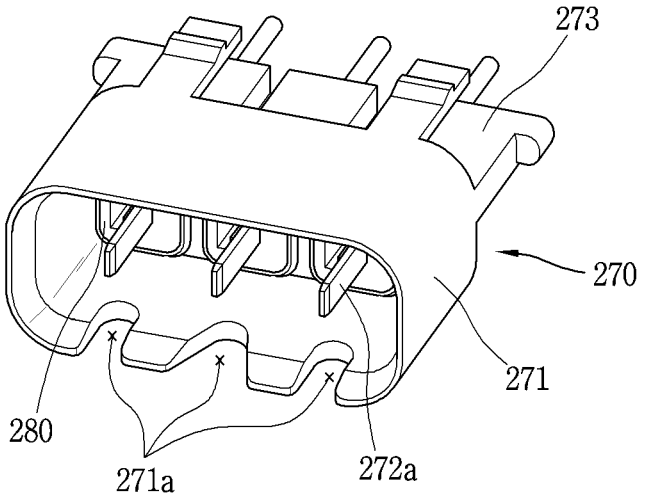

(a) of FIG. 12 is a perspective view illustrating a rear side of the detergent storage container 221, 222, and (b) of FIG. 12 is a perspective view illustrating the connection terminal portion 262. In addition, (a) of FIG. 13 is a perspective view illustrating an example state in which the laundry detergent pumps 231, 232 are coupled to the housing 210, and (b) of FIG. 13 is a perspective view illustrating the connection terminal receiving member 270.

The connection terminal portion 262 is installed to be fitted to the outer portion of the support bracket 261, and is connected to the connection terminal receiving member 270 coupled with the laundry detergent pump to serve to enable an operation of the residual amount detecting unit 260.

In some examples, the connection terminal portion 262 may include a support bracket fitting portion 262*c* that protrudes from the connection terminal portion 262, and the support bracket fitting portion 262*c* may be inserted into the support bracket 261.

At this time, the connection pin receiving member 262*a* may be installed inside the connection terminal portion 262, and when the connection terminal portion 262 is inserted into the connection terminal receiving member 270, the connection pin 272*a* of the connection terminal receiving member 270 is inserted toward the connection pin receiving member 262*a* installed inside the connection terminal portion 262. Here, the residual amount detecting unit 260 may detect the residual amount of the detergent by a current value using the detergent stored in each of the detergent storage containers 221, 222 as a medium.

A plurality of partition wall portions 262*b* configured to divide the connection pin receiving holes 262*d* from each other may be formed in the connection terminal portion 262. A sealing member insertion portion 262*e* may be partitioned by the plurality of partition wall portions 262*b*, and a sealing member 280, which will be described later, may be positioned therein.

The connection terminal receiving member 270 may include a connection terminal housing 271 and the connection terminal 272.

The connection terminal housing 271 defines an external appearance. At one side of the connection terminal housing 271, the coupling portion 221*d* may be formed to supply power to allow a connected state of the connection terminal 272.

The connection terminal 272 is fixedly installed inside the connection terminal housing, and when the connection terminal portion 262 is inserted, the connection terminal portion 262 and the electrode 263 are electrically connected to each other. The connection pin 272*a* is fixedly installed inside the connection terminal 272, and the connection pin 272*a* may protrude toward the connection pin receiving member 262*a* so as to be inserted into or withdrawn from the connection pin receiving member 262*a*.

The connection terminal receiving member 270 is connected to the laundry detergent pumps 231, 232 and may be installed to face each of the detergent storage containers 221, 222. The connection terminal portion 262 may be inserted into the connection terminal receiving member 270 to be electrically connected thereto.

In some implementations, as illustrated in (b) of FIG. 13, a detergent outlet hole 271*a* may be formed at a lower surface of the connection terminal housing 271 so that laundry detergent flowing into the connection terminal housing 271 is discharged therethrough.

The detergent outlet hole 271*a* is formed in a predetermined shape to be penetrated up and down, and has a structure that may smoothly discharge laundry detergent flowing into the connection terminal housing 271. The detergent outlet hole 271*a* may be formed in plural, and may be in parallel with each other at a predetermined distance.

Figure 14:
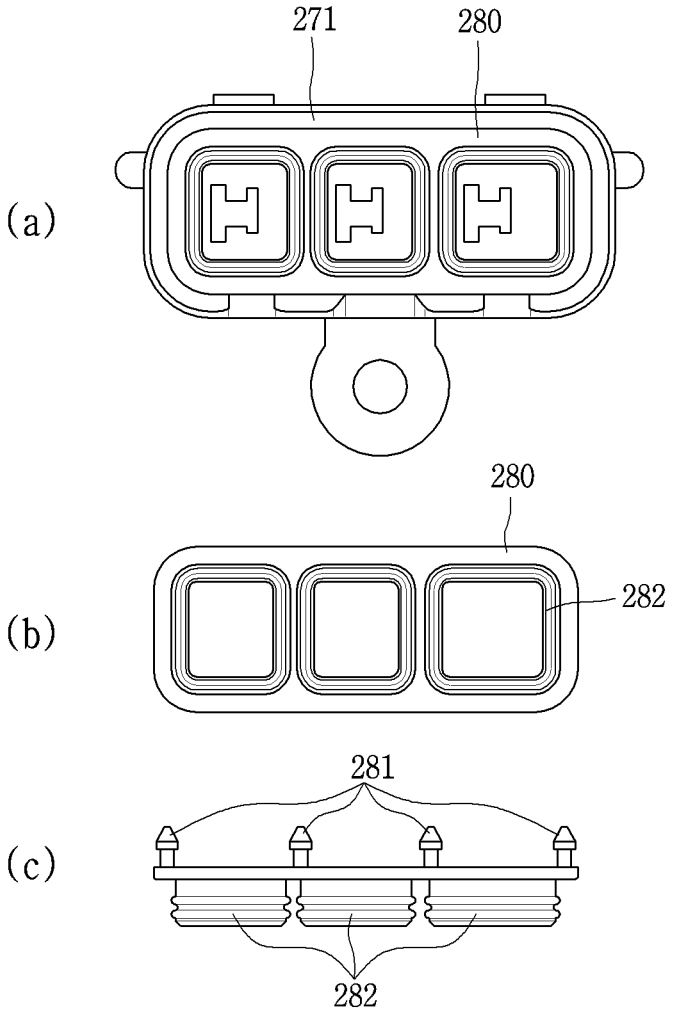
FIG. 14 illustrates an example of a sealing member.

(a), (b), and (c) of FIG. 14 are conceptual views each illustrating the sealing member 280.

The detergent supply device 200 may be configured to further include the sealing member 280 fitted into the connection terminal housing 271.

The connection terminal housing 271 defines an appearance and may be fixed to the housing 210. The connection terminal receiving member 270 may include a connection terminal housing 271 and the connection terminal 272.

The sealing member 280 may be made of a rubber material to seal between each terminal supporting the electrode 263.

In some implementations, the sealing member 280 may partition the connection terminals 272 into different regions to block them from each other. For example, as illustrated in (a) and (b) of FIG. 14, the sealing member 280 may be partitioned into three regions.

Coupling protrusions 281 may protrude in one direction at one surface of the sealing member 280 so as to be fixed to the connection terminal housing 271. The coupling protrusions 281 may be fitted into the connection terminal housing 271, and the sealing member 280 may be fixed to the connection terminal housing 271.

In some implementations, at another surface of the sealing member 280, a shield portion 282 protruding in one direction so as to be coupled to the connection terminal portion 262 may be provided.

The sealing member 280 is located between the connection terminal portion 262 and the connection terminal housing 271.

The connection terminal 272 is fixedly installed inside the connection terminal housing 271, and when the connection terminal portion 262 is inserted, the connection terminal portion 262 and the electrode 263 are electrically connected to each other. Here, the sealing member 280 may be positioned to be inserted into a plurality of partition walls 262*b* configured to partition the connection pin receiving holes 262*d* from each other.

Figure 15:
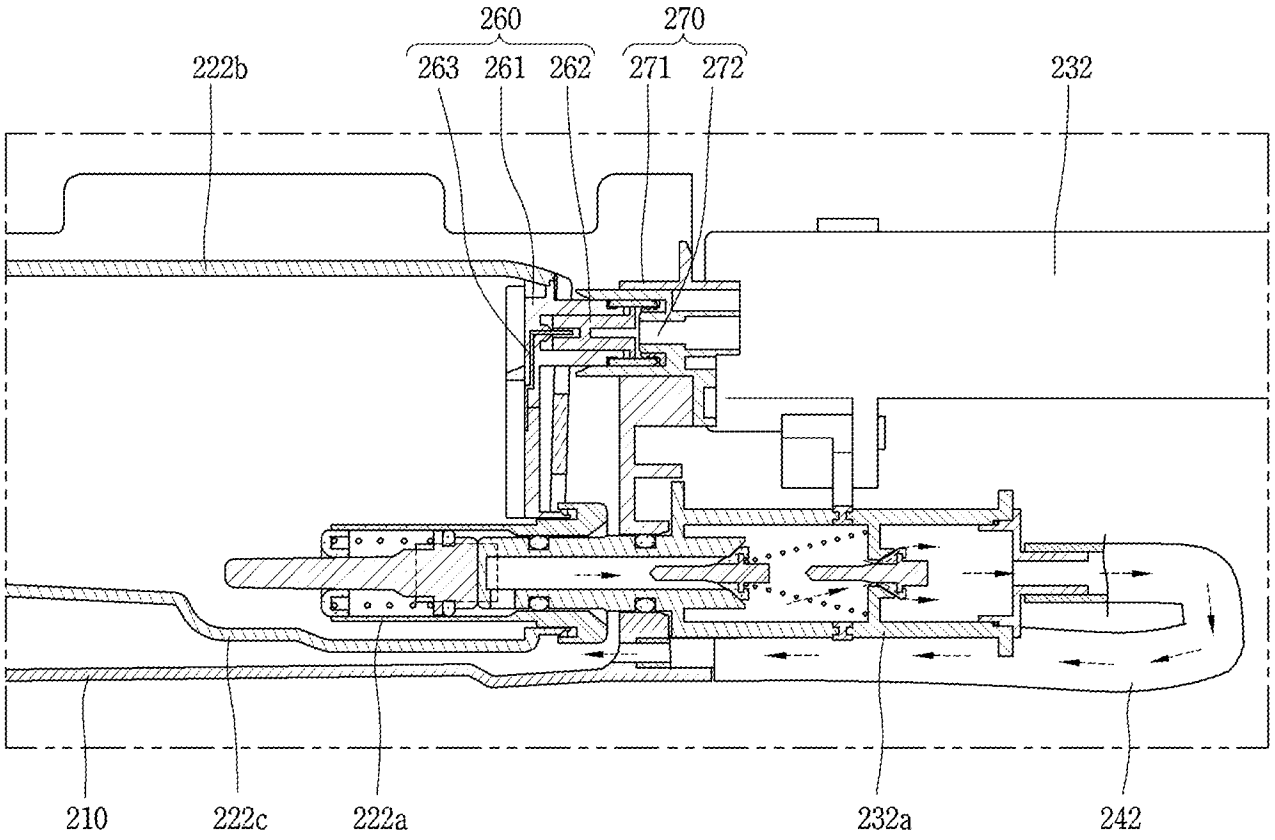
FIG. 15 is a horizontal sectional view of the detergent supply device.

FIG. 15 is a horizontal sectional view of the detergent supply device 200 illustrating a movement of the laundry detergent stored in the detergent storage container.

As described above, when the housing 210 is inserted into the interior of the main body 110, laundry detergent stored in each of the detergent storage containers 221, 222 may be introduced into the housing 210 by an operation of the laundry detergent pump 230 installed at the rear of each detergent storage container 221, 222.

Here, at a rear surface portion of each detergent storage container 221, 222, the pump receiving portion 221*a*, 222*a* may be protruded from the laundry detergent pump 231, 232 to communicate with an inside of the detergent storage container 221, 222.

In some implementations, the first laundry detergent suction pipe 231*a* protruding from the first laundry detergent pump 231 may be located in a state of being accommodated in the first pump receiving portion 221*a* of the first storage container 221, and thus laundry detergent stored in the first detergent storage container 221 may be sucked by the operation of the first laundry detergent pump 231, and discharged through the first laundry detergent inlet hole 211*a* via the first laundry detergent inlet pipe 241.

Furthermore, the second pump valve 232*a* protruding from the second laundry detergent pump 232 may be located in a state of being accommodated in the second pump receiving portion 222*a* of the second detergent storage container 222, and thus laundry detergent stored in the second detergent storage container 222 may be sucked by the operation of the second laundry detergent pump 232, and discharged through the second laundry detergent inlet hole 211*b* via the second laundry detergent inlet pipe 242.

At this time, wash water may be introduced through the wash water inlet portions 251*c*, 251*c*', 251*c*" disposed in the wash water dispenser 251, and the introduced wash water may be moved through the first and second wash water passages 251*a*, 251*b*, and then discharged toward the inclined portion 215*b* via the wash water movement hole 254.

Wash water may be mixed with laundry detergent moving toward the detergent input hole 214 along the first laundry detergent passage 211 and the second laundry detergent passage 212, and may move downward by its own weight, and then move towards the tub.

In other words, laundry detergent moving into the housing 210 from each detergent storage container 221, 222 through the detergent input hole 214 may be moved through the first and second laundry detergent passages 211, 212, and then mixed with wash water flowing into the housing 210, and then supplied to the tub through the detergent input hole 214.

In some implementations, the residual amount detecting unit 260 installed in the detergent supply device 200 detects the residual amount of the laundry detergent stored in each detergent storage container 221, 222, and when the residual amount of the laundry detergent is lower than a reference value, the residual amount detecting unit 260 notifies users of this information, thereby enhancing user's convenience.

Hereinafter, a method for manufacturing the detergent storage containers 221, 222 will be described.

Figure 16:
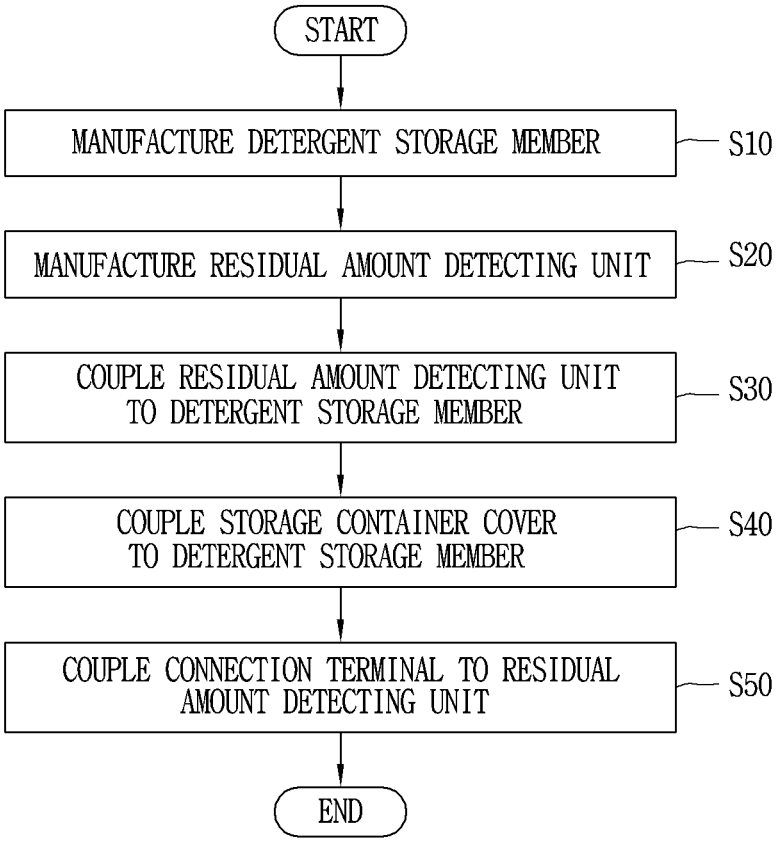
FIG. 16 is a flowchart illustrating an example method for manufacturing the detergent storage container.

FIG. 16 is a flowchart illustrating a method for manufacturing the detergent storage container 221, 222.

The first detergent storage container 221 and the second detergent storage container 222 are installed in the housing 210, respectively, to supply different laundry detergents stored in each of the detergent storage members 221*c*, 222*c* through each of the laundry detergent pumps 231, 232.

Here, the residual amount detecting unit 260 installed in each of the detergent storage containers 221, 222 may detect the residual amount of the laundry detergent stored in each detergent storage member 221*c*, 222*c* by detecting current applied in each detergent storage container 221, 222. Accordingly, the residual amount of the detergent stored in each detergent storage container 221, 222 is automatically detected by the residual amount detecting unit 260, thereby further enhancing user's convenience.

The method for manufacturing the detergent storage containers 221, 222 may include manufacturing the detergent storage member 221*c*, 222*c* (S10), manufacturing the residual amount detecting unit 260 (S20), coupling the residual amount detecting unit 260 to the detergent storage member 221*c*, 222*c* (S30), coupling the storage container cover 221*b*, 222*b* to the detergent storage member 221*c*, 222*c* (S40), and coupling the connection terminal portion 262 to the residual amount detecting unit 260 (S50).

The detergent storage member 221*c*, 222*c* may be made of a plastic material, and may be manufactured by an injection-molding manner after manufacturing a mold.

The detergent storage member 221*c*, 222*c* may be manufactured through a first step by plastic injection after manufacturing a "⊏"-shaped mold.

For instance, the first step may include a step of manufacturing the detergent storage member 221*c*, 222*c*.

Here, the first step S10 may further include a step of forming a coupling portion 221*d* penetrating the rear surface of the detergent storage member 221*c*, 222*c*. However, the coupling portion 221*d* may be formed in the injection process of the detergent storage member 221*c*, 222*c*, in which case, a separate manufacturing process is not needed.

In some implementations, the first step S10 may further include forming the mounting groove 221*e* configured to guide the residual amount detecting unit 260 to be mounted on the circumference of the coupling portion 221*d*.

The mounting groove 221*e* may be formed along the circumference of the coupling portion 221*d* penetrating the rear surface of each detergent storage member 221*c*, 222*c*. As such, the process of forming the mounting groove 221*e* may further include a separate manufacturing step, or may not further include a separate step by the injection process of the detergent storage member 221*c*, 222*c*.

In some implementations, as illustrated in FIG. 10, the method for manufacturing the detergent storage container 221, 222 may include a second step S20 of manufacturing the residual amount detecting unit 260.

The second step may include a step of manufacturing the residual amount detecting unit 260.

The residual amount detecting unit 260 may be manufactured by an insert-molding manner, such that a plurality of electrodes 263 is coupled to the support bracket 261 having one surface of a plate shape.

Here, the electrode 263 includes a horizontal portion 263*a*″ to be fixed to the electrode sensor terminal 264 and a vertical portion 263*a*′ bent from the horizontal portion 263*a*″ and extending in a direction intersecting with the horizontal portion 263*a*", and its shape is same as the one described above in FIG. 10.

When a plurality of electrodes 263 is installed by an insert-molding manner, at least a part of the electrode 263 is exposed at one side of the support bracket 261, and another side protrudes to outside so that the connection terminal portion 262 is coupled thereto.

In some implementations, the second step may include forming a mounting protrusion 261*a* to correspond to the mounting groove 221*e* along the outer circumference of the support bracket 261.

Here, the step of forming the mounting protrusion 261*a* may refer to a step of marking a marking portion in the mounting groove 221*e* so that the residual amount detecting unit 260 may be easily seated on the coupling portion 221*d* formed on the rear surface of the detergent storage member 221*c*, 222*c*.

The mounting protrusion 261*a* may be formed by a separate manufacturing process of the support bracket 261, or may be integrally formed by an insert-molding manner in which a plurality of electrodes 263 is coupled to the support bracket 261.

In some implementations, the second step S20 may include a step of forming the detergent blocking rib 265 at one surface located inside the detergent storage member 221*c*, 222*c* of the support bracket 261 to be protruded in a shape surrounding one side of the exposed electrode 263.

Here, the detergent blocking rib 265 may be formed integrally with the support bracket 261, or may be manufactured as a separate member and then coupled to the support bracket 261 by bonding.

The manufacturing method of the detergent storage container 221, 222 may include the third step S30 in which closely adhering the residual amount detecting unit 260 to the coupling portion 221*d*.

The third step S30 may include a step of bringing the residual amount detecting unit 260 into close contact with the coupling portion.

The third step S30 may be configured to a step of locating the mounting protrusion 261*a* in the mounting groove 221*e*, then coupling the mounting protrusion 261*a* to the mounting groove 221*e* by bonding or heat welding.

Since the mounting groove 221*e* and the mounting protrusion 261*a* are positioned in contact with each other, the support bracket 261 may be more easily seated on the detergent storage member 221*c*, 222*c*. Accordingly, a productivity of assembly may be further enhanced.

The manufacturing method of the detergent storage container 221, 222 may include a fourth step S40 of coupling the storage container cover to an upper portion of the detergent storage member 221*c*, 222*c*.

The fourth step S40 may refer to a step of coupling the storage container cover 221*b*, 222*b* to the detergent storage member 221*c*, 222*c* along the upper surface of the detergent storage member 221*c*, 222*c* by heat welding.

The surface along the circumference of the storage container cover 221*b*, 222*b* and the upper opening surface of the detergent storage member 221*c*, 222*c* may be supported by each other, and they may be coupled to each other by forming a welding surface 221*f* through heat welding.

The manufacturing method of the detergent storage container 221, 222 may include a fifth step S50 of coupling the connection terminal portion 262 for electrical connection to the exposed outer surface of the residual amount detecting unit 260.

The connection terminal portion 262 may be separately manufactured through an injection process, or may be integrally formed on the exposed outer surface of the residual amount detecting unit 260 or on the exposed outer surface of the support bracket 261. The connection terminal receiving member 270 formed on an inner surface of the housing may be coupled to the connection terminal portion 262, and in this case, the residual amount detecting unit 260 is in an operable state.

In some implementations, the manufacturing method of the detergent storage container 221, 222 may further include a sixth step of mounting the plug 224 for opening and closing the storage space in an opening hole formed in the storage container cover 221*b*, 222*b*.

The plug 224 may be detachable from the detergent storage container 221, 222 when rotated in one direction. Accordingly, when the plug 224 is removed from the detergent storage container 221, 222, the user will be able to supply laundry detergent to the detergent storage container 221, 222.

Figure 17:
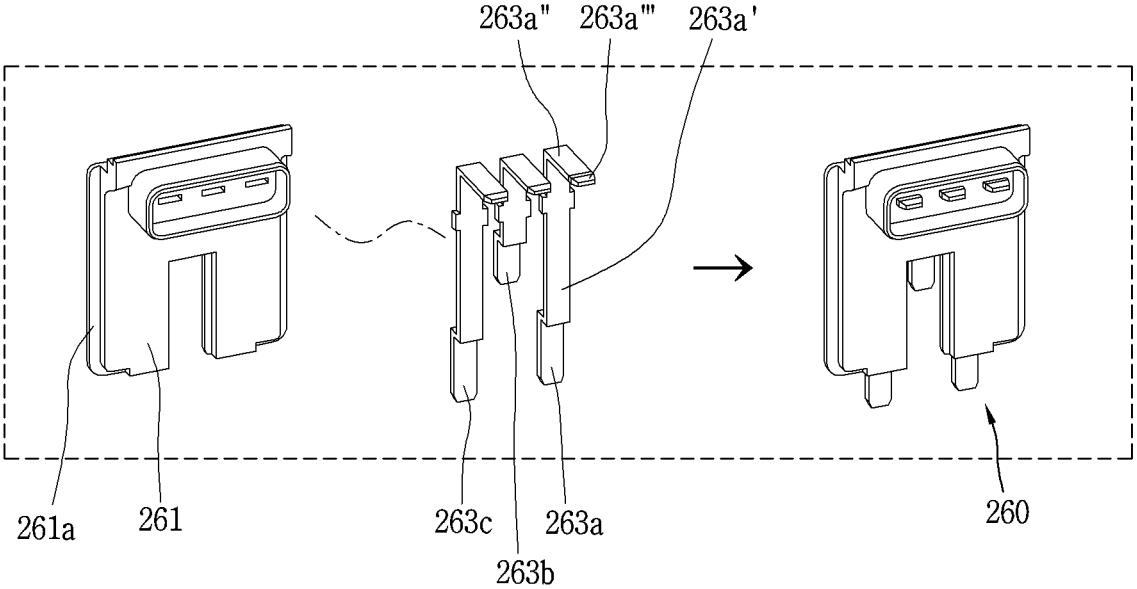
FIG. 17 is a conceptual view illustrating an example state in which the electrode is being coupled to the support bracket.

FIG. 17 is a conceptual view illustrating an example state in which the electrode 263 is coupled to the support bracket 261 by applying the second step S20 of manufacturing the residual amount detecting unit 260.

The residual amount detecting unit 260 may be installed in each of the first detergent storage container 221 and the second detergent storage container 222, and may detect the residual amount of the laundry detergent stored in the first and second detergent storage containers 221, 222.

Specifically, the residual amount detecting unit 260 may detect the residual amount of the detergent stored in each of the detergent storage containers 221, 222 by applying a current of a set magnitude into the detergent storage members 221*c*, 222*c* then measuring the current detected by the electrode sensor.

As illustrated in FIG. 17, the residual amount detecting unit 260 may include the support bracket 261, the connection terminal portion 262, and the electrode 263.

The residual amount detecting unit 260 may be manufactured by an insert-molding manner, such that a plurality of electrodes 263 is coupled to the support bracket 261 having one surface of a plate shape.

Here, the electrode 263 may include a horizontal portion 263*a*″ to be fixed to the electrode sensor terminal 264 and a vertical portion 263*a*′ bent from the horizontal portion 263*a*″ and extending in a direction intersecting with the horizontal portion 263*a*″.

The plurality of electrodes 263 may be installed inside the support bracket 261 by an insert-molding manner. At least a part of the electrode 263 is exposed at one side of the support bracket 261, and another side protrudes to outside so that the connection terminal portion 262 is coupled thereto.

In some examples, the second step S20 may include forming the mounting protrusion 261*a* to correspond to the mounting groove 221*e* along the outer circumference of the support bracket 261.

The step of forming the mounting protrusion 261*a* may refer to a step of marking a seating position of the residual amount detecting unit 260 in the mounting groove 221*e* so that the residual amount detecting unit 260 may be easily seated on the coupling portion 221*d* formed on the rear surface of the detergent storage member 221*c*, 222*c*.

The mounting protrusion 261*a* may be formed by a separate manufacturing process of the support bracket 261, or may be integrally formed by an insert-molding manner in which the plurality of electrodes 263 is coupled to the support bracket 261.

In some examples, the second step S20 may include a step of forming the detergent blocking rib 265 at one surface located inside the detergent storage member 221*c*, 222*c* of the support bracket 261 to be protruded in a shape surrounding one side of the exposed electrode 263.

Figure 18:
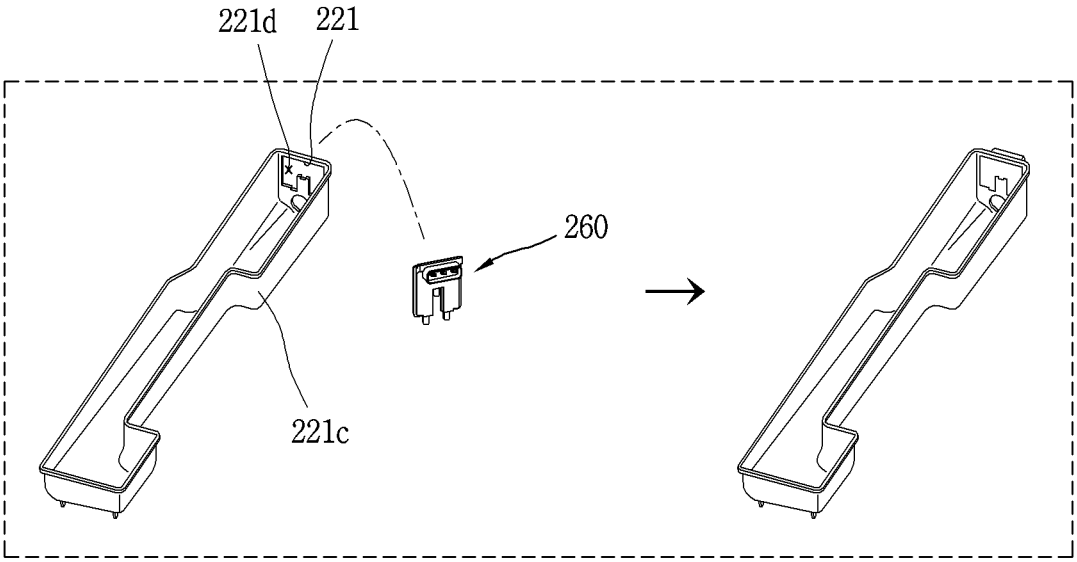
FIG. 18 is a conceptual view illustrating an example state in which the support bracket is coupled to a detergent storage member of the detergent storage container.

FIG. 18 is a conceptual view illustrating an example state in which the support bracket 261 is coupled to the detergent storage member 221*c*, 222*c* of the detergent storage container 221, 222, specifically a state where the residual amount detecting unit 260 is closely adhered to the coupling portion 221*d*.

The third step S30 of closely adhering the residual amount detecting unit 260 to the coupling portion 221*d* may be configured to a step of locating the mounting protrusion 261*a* in the mounting groove 221*e*, then coupling the mounting protrusion 261*a* to the mounting groove 221*e* by bonding or heat welding.

For example, as illustrated in FIG. 18, the residual amount detecting unit 260 may be installed at the coupling portion 221*d* formed at one side of the rear surface of the first detergent storage member 221*c*. Here, the mounting groove 221*e* is recessed in the circumferential portion of the coupling portion 221*d*, and the mounting protrusion 261*a* formed at an outline of the support bracket 261 configuring the residual amount detecting unit 260 is positioned to fit perfectly in the mounting groove 221*e*, so that the ease of assembly may be further improved.

That is, since the mounting protrusion 261*a* is positioned in the mounting groove 221*e*, the support bracket 261 may be more easily seated on the detergent storage member 221*c*, 222*c* by their positions.

Through the third step S30, the support bracket 261 is coupled to the rear surfaces of each of the first and second detergent storage members 221*c*, 222*c* by bonding, and one surface of the support bracket 261 is accommodated in the inner space of each of the detergent storage members 221*c*, 222*c*, and another surface protrudes outwardly of each of the detergent storage members 221*c*, 222*c*. In some examples, at one side of the rear surface of the detergent storage container 221, 222, at least a part of the electrode 263 coupled to the support bracket 261 by insert-injection may be located to be exposed inside the first and second detergent storage members 221*c*, 222*c*.

Accordingly, on one side of each of the first detergent storage member 221*c* and the second detergent storage member 222*c*, the residual amount detecting unit 260 is respectively installed to detect a residual amount of laundry detergent stored in each of the detergent storage members 221*c*, 222*c*.

Figure 19:
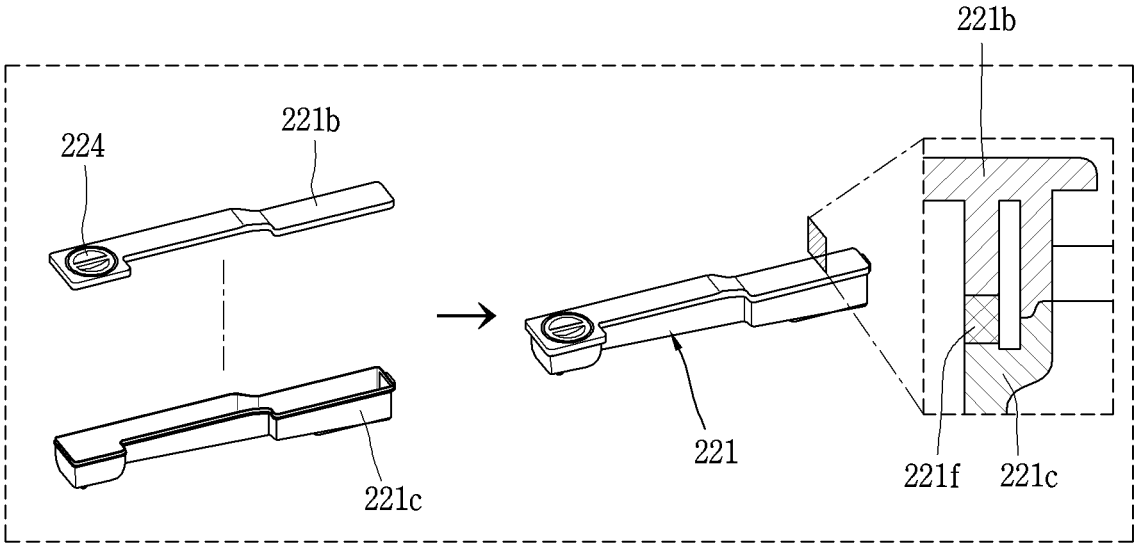
FIG. 19 is a conceptual view illustrating an example state in which a storage container cover is being coupled to the detergent storage member.

FIG. 19 is a conceptual view illustrating an example state in which the storage container cover 221*b* is being coupled to the detergent storage member 221*c*, which is illustrating the fourth step S40 of coupling the storage container cover to the upper portion of the detergent storage member 221*c*, 222*c*.

Through the fourth step S40, the storage container covers 221*b*, 222*b* to cover each of the detergent storage members 221*c*, 222*c* may be coupled to the detergent storage members 221*c*, 222*c* in which laundry detergent is stored.

The storage container cover 221*b*, 222*b* is configured to correspond to the shape of the laundry detergent storage member 221*c*, 222*c*, so that the interior of the laundry detergent storage member 221*c*, 222*c* may be sealed.

The storage container cover 221*b*, 222*b* is installed to cover the upper opening of the detergent storage member 221*c*, 222*c*, and the welding surface 221*f* is formed between the upper surface of the detergent storage member 221*c*, 222*c* and the circumference of the storage container cover 221*b*, 222*b* to closely adhere them to each other.

That is, the storage container cover 221*b*, 222*b* may be coupled to the upper surface of the detergent storage member 221*c*, 222*c* by heat welding.

Figure 20:
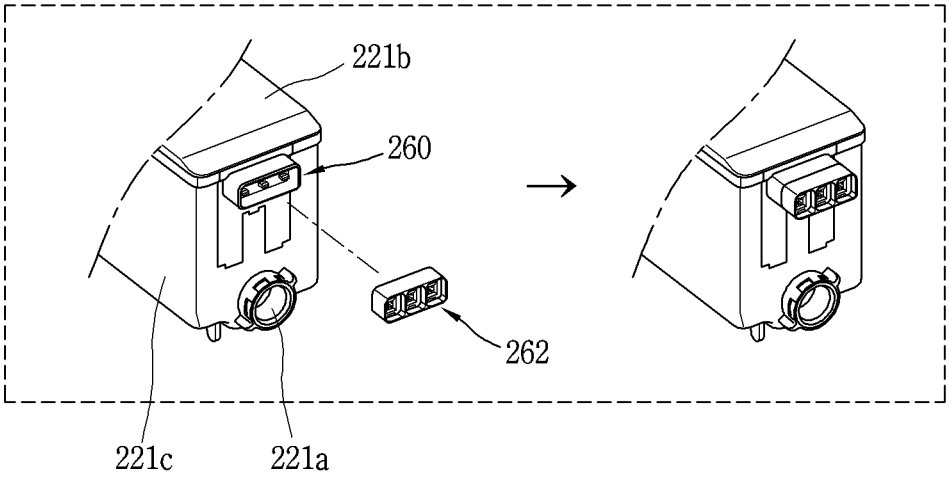
FIG. 20 is a conceptual view illustrating an example state in which the connection terminal portion is installed at an outer side of the support bracket.

FIG. 20 illustrates an example state in which the connection terminal portion 262 is installed on the outside of the support bracket 261, which is a fifth step of coupling the connection terminal portion 262 for electrical connection to the exposed outer surface of the residual amount detecting unit 260.

The connection terminal portion 262 may be separately manufactured by an injection process, and is coupled to an exposed outer surface of the residual amount detecting unit 260 or to an exposed outer surface of the support bracket 261 to allow the residual amount detecting unit 260 to be operable by being coupled to the connection terminal receiving member 270 installed on the inner surface of the housing 210.

That is, the connection terminal portion 262 is installed to be fitted to the outer portion of the support bracket 261, and is connected to the connection terminal receiving member 270 coupled with the laundry detergent pump to serve to enable an operation of the residual amount detecting unit 260.

When the connection terminal portion 262 is inserted into the connection terminal receiving member 270, the connection pin 272*a* of the connection terminal receiving member 270 is electrically connected.

In some examples, the residual amount detecting unit 260 may detect the residual amount of the detergent and detect whether the residual amount of the detergent is insufficient by measuring a current value using the detergent stored in each of the detergent storage containers 221, 222 as a medium.

The foregoing description is merely examples for implementing a detergent storage container and a detergent supply device including the same, and the present disclosure is not limited to the above implementations, and various modifications and improvements will become apparent to those skilled in the art without departing from the concept and scope of the present disclosure as disclosed in the following claims.

What is claimed is:

1. A detergent storage container for a laundry treating apparatus, the detergent storage container comprising:

a detergent storage member that defines a storage space configured to store laundry detergent, the detergent storage member being configured to be inserted rearwardly into a housing disposed in the laundry treating apparatus; and a residual amount detecting unit configured to detect a residual amount of laundry detergent stored in the detergent storage member, wherein the detergent storage member has a bottom surface and a rear surface, the rear surface being disposed at a rear of the storage space and protruding upwardly from the bottom surface, and wherein the residual amount detecting unit comprises an electrode, the electrode comprising:

a support bracket that is coupled to the detergent storage member and defines at least a part of the rear surface of the detergent storage member, a first portion that is disposed in the support bracket in the rear surface of the detergent storage member, a second portion that extends from the first portion toward the bottom surface of the detergent storage member and is disposed at an inside portion of the support bracket, the second portion being located inside the storage space of the detergent storage member, and a third portion that extends from the first portion in a direction away from the rear surface of the detergent storage member and is disposed at an outer portion of the support bracket, the third portion being located outside the storage space of the detergent storage member.

2. The detergent storage container of claim 1, wherein the detergent storage member comprises a coupling portion having a shape corresponding to an outer shape of the residual amount detecting unit.

3. The detergent storage container of claim 2, wherein the detergent storage member defines a mounting groove that is recessed along a circumference of the coupling portion, the residual amount detecting unit being fitted to the mounting groove.

4. The detergent storage container of claim 1, wherein the residual amount detecting unit further comprises a detergent blocking rib that protrudes from the inside portion of the support bracket and that covers the second portion of the electrode disposed inside the detergent storage member.

5. The detergent storage container of claim 4, wherein the detergent blocking rib comprises a blocking portion that is inclined with respect to a vertical direction passing the bottom surface of the detergent storage member, the blocking portion being configured to restrict movement of the laundry detergent toward the second portion of the electrode.

6. The detergent storage container of claim 1, wherein the electrode comprises a plurality of electrodes having different lengths from one another, the plurality of electrodes comprising:

a first electrode disposed at a first height from the bottom surface of the detergent storage member, and a second electrode disposed at a second height from the bottom surface of the detergent storage member, the second height being different from the first height.

7. The detergent storage container of claim 1, wherein the residual amount detecting unit further comprises an electrode sensor terminal that is disposed at the third portion of the electrode, the electrode sensor terminal being configured to transmit electrical signals.

8. The detergent storage container of claim 1, wherein the detergent storage member comprises a pump receiving portion configured to discharge the laundry detergent in the detergent storage container, and wherein the residual amount detecting unit is disposed at the rear surface of the detergent storage member above the pump receiving portion.

9. The detergent storage container of claim 8, wherein the residual amount detecting unit and the pump receiving portion protrude rearward relative to the rear surface of the detergent storage member.

10. The detergent storage container of claim 8, further comprising a connection terminal portion that is coupled to the outer portion of the support bracket and covers the third portion of the electrode, wherein the connection terminal portion is disposed above the pump receiving portion.

11. The detergent storage container of claim 1, wherein the residual amount detecting unit further comprises a connection terminal portion disposed at the outer portion of the support bracket, the connection terminal portion being located outside the detergent storage container and configured to transmit electrical signals from the electrode.

12. The detergent storage container of claim 1, further comprising:

a connection terminal portion that is the outer portion of the support bracket and covers the third portion of the electrode; and a connection terminal receiving member disposed at a rear portion of the housing and configured to couple to the connection terminal portion.

13. The detergent storage container of claim 1, further comprising a connection terminal portion that is coupled to the outer portion of the support bracket and covers the third portion of the electrode, wherein the rear surface of the detergent storage member defines a coupling portion that is an opening and receives the residual amount detecting unit, and wherein the connection terminal portion passes through the coupling portion and protrudes rearward relative to the rear surface of the detergent storage member.

14. The detergent storage container of claim 13, wherein the electrode vertically extends along the rear surface of the detergent storage member to a position below a lower end of the coupling portion.

15. A detergent supply device for a laundry treating apparatus, the detergent supply device comprising:

a housing configured to be disposed inside the laundry treating apparatus;

a storage container frame configured to be inserted rearwardly into the housing;

a detergent storage container configured to be inserted into the storage container frame in an insertion direction and to store laundry detergent;

a laundry detergent pump disposed at an outside of the housing and coupled to the housing; and a connection terminal receiving member that is disposed inside the housing and protrudes toward the detergent storage container, wherein the detergent storage container comprises:

a detergent storage member that defines a storage space configured to store the laundry detergent, and a residual amount detecting unit configured to detect a residual amount of laundry detergent stored in the detergent storage member, wherein the detergent storage member has a lower surface and a rear surface, the rear surface being located at a rear of the storage space and protruding upwardly from the lower surface, and wherein the residual amount detecting unit comprises an electrode, the electrode comprising:

a support bracket that is coupled to the detergent storage member and defines at least a part of the rear surface of the detergent storage member, a first portion that is disposed in the support bracket in the rear surface of the detergent storage member, a second portion that extends from the first portion toward the lower surface of the detergent storage member and is disposed at an inside portion of the support bracket, the second portion being located inside the storage space of the detergent storage member, and a third portion that extends from the first portion in the insertion direction of the detergent storage container and is disposed at an outer portion of the support bracket, the third portion being located outside the storage space of the detergent storage member.

16. The detergent supply device of claim 15, further comprising a detergent suction pipe that is disposed below the connection terminal receiving member and protrudes from a rear portion of the housing toward the storage space of the detergent storage member.

17. The detergent supply device of claim 15, further comprising a detergent suction pipe that is connected to the laundry detergent pump and configured to receive the laundry detergent stored in the detergent storage container.

18. The detergent supply device of claim 15, wherein the detergent storage member comprises a pump receiving portion that protrudes from the rear surface of the detergent storage member and that is configured to receive the laundry detergent pump, and wherein the residual amount detecting unit is disposed above the pump receiving portion.

19. The detergent supply device of claim 15, further comprising a connection terminal portion that is coupled to the outer portion of the support bracket and covers the third portion of the electrode, wherein the connection terminal portion is inserted into and electrically connected to the connection terminal receiving member.

20. The detergent supply device of claim 15, further comprising a connection terminal portion that is coupled to the outer portion of the support bracket and covers the third portion of the electrode, wherein the electrode comprises a plurality of electrodes, and wherein the connection terminal receiving member comprises:

a connection terminal housing that defines an appearance of the connection terminal receiving member, and a plurality of connection terminals that are configured to be connected to the plurality of electrodes based on the connection terminal portion being inserted into the connection terminal housing.

21. The detergent supply device of claim 20, further comprising a sealing member disposed in the connection terminal receiving member and configured to fit into the connection terminal housing, the sealing member having a plurality of regions that separate the plurality of connection terminals from one another.

22. The detergent supply device of claim 20, wherein the connection terminal housing defines a detergent outlet hole at a lower surface of the connection terminal housing, and is configured to discharge the laundry detergent in the connection terminal housing through the detergent outlet hole.

23. The detergent supply device of claim 15, wherein the detergent storage member comprises a pump receiving portion that protrudes toward the laundry detergent pump from a rear portion of the detergent storage container, and wherein the laundry detergent pump is configured to receive the laundry detergent in the detergent storage container through the pump receiving portion.

24. The detergent supply device of claim 23, further comprising a connection terminal portion that is coupled to the outer portion of the support bracket and covers the third portion of the electrode, wherein the connection terminal portion is inserted into and electrically connected to the connection terminal receiving member, and wherein the connection terminal portion is disposed above the pump receiving portion.

* * * * *